US009953498B2

(12) United States Patent
Van Landingham, Jr. et al.

(10) Patent No.: US 9,953,498 B2
(45) Date of Patent: Apr. 24, 2018

(54) WRAP FOR AN ITEM OF MERCHANDISE

(71) Applicant: InVue Security Products Inc., Charlotte, NC (US)

(72) Inventors: A. Reneau Van Landingham, Jr., Pineville, NC (US); James K. Sankey, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

(21) Appl. No.: 15/037,098

(22) PCT Filed: Nov. 13, 2014

(86) PCT No.: PCT/US2014/065448
§ 371 (c)(1),
(2) Date: May 17, 2016

(87) PCT Pub. No.: WO2015/073668
PCT Pub. Date: May 21, 2015

(65) Prior Publication Data

US 2016/0307417 A1 Oct. 20, 2016

Related U.S. Application Data

(60) Provisional application No. 61/905,477, filed on Nov. 18, 2013, provisional application No. 61/936,526, filed on Feb. 6, 2014.

(51) Int. Cl.
*G08B 13/14* (2006.01)
*E05B 73/00* (2006.01)
(Continued)

(52) U.S. Cl.
CPC ..... *G08B 13/1463* (2013.01); *E05B 47/0009* (2013.01); *E05B 73/0029* (2013.01);
(Continued)

(58) Field of Classification Search
CPC ..... G08B 13/1463
See application file for complete search history.

(56) References Cited

U.S. PATENT DOCUMENTS 5,722,266 A 3/1998 Yeager et al.
5,794,464 A 8/1998 Yeager et al.
(Continued)

FOREIGN PATENT DOCUMENTS

EP 1027514 B1 4/2002

OTHER PUBLICATIONS

Shane Thomas, Notification of Transmittal of the International Search Report and the Written Opinion of the International Searching Authority, of the Declaration of International (PCT) Application No. PCT/US2014/065448, dated Feb. 26, 2015, 10 pages, Commissioner for Patents, Alexandria, Virginia.
(Continued)

*Primary Examiner* — Joseph Feild
*Assistant Examiner* — Pameshanand Mahase
(74) *Attorney, Agent, or Firm* — InVue Security Products Inc.

(57) ABSTRACT

A merchandise security device configured for use with an electronic key for locking and/or unlocking a lock mechanism is provided. The merchandise security device may include a housing operably coupled with a cable, wherein the cable is configured to be extended and retracted relative to the housing and to at least partially surround an item of merchandise. The security device may also include a lock mechanism configured to releasably secure the cable relative to the housing for locking the cable about the item of merchandise. In addition, the lock mechanism is configured to receive electrical power for unlocking the lock mechanism so that the housing and the cable may be removed from the item of merchandise.

22 Claims, 18 Drawing Sheets

(51) Int. Cl.

| | |
|---|---|
| ***G08B 13/24*** | (2006.01) |
| ***E05B 47/00*** | (2006.01) |
| *G08B 25/00* | (2006.01) |
| *G08B 29/04* | (2006.01) |

(52) U.S. Cl.
CPC ..... *G08B 13/1472* (2013.01); *G08B 13/2434* (2013.01); *G08B 25/008* (2013.01); *G08B 29/046* (2013.01)

(56) References Cited

U.S. PATENT DOCUMENTS

| | | | |
|---|---|---|---|
| 6,092,401 | A | 7/2000 | Sankey et al. |
| 6,755,055 | B2 | 6/2004 | Sedon et al. |
| 6,933,847 | B2 | 8/2005 | Feibelman |
| 7,062,823 | B2 | 6/2006 | Copen et al. |
| 7,129,841 | B2 | 10/2006 | Feibelman |
| 7,162,899 | B2 | 1/2007 | Fawcett et al. |
| 7,168,275 | B2 | 1/2007 | Fawcett et al. |
| D545,228 | S | 6/2007 | Fawcett et al. |
| 7,227,467 | B2 | 6/2007 | Feibelman |
| 7,249,401 | B2 | 7/2007 | Copen et al. |
| 7,251,966 | B2 | 8/2007 | Fawcett et al. |
| D555,023 | S | 11/2007 | Fawcett et al. |
| D555,024 | S | 11/2007 | Fawcett et al. |
| D556,072 | S | 11/2007 | Fawcett et al. |
| 7,350,381 | B2 | 4/2008 | Fawcett et al. |
| 7,403,118 | B2 | 7/2008 | Belden, Jr. |
| 7,453,370 | B2 | 11/2008 | Marsilio et al. |
| 7,474,209 | B2 | 1/2009 | Marsilio et al. |
| 7,481,086 | B2 | 1/2009 | Fawcett et al. |
| 7,497,100 | B2 | 3/2009 | Fawcett et al. |
| 7,497,101 | B2 | 3/2009 | Fawcett et al. |
| 7,518,521 | B2 | 4/2009 | Feibelman et al. |
| 7,659,817 | B2 | 2/2010 | Conti et al. |
| 7,685,850 | B2 | 3/2010 | Nilsson |
| 7,808,382 | B2 | 10/2010 | Bonato |
| 7,918,112 | B2 | 4/2011 | Fawcett et al. |
| 7,984,629 | B2 | 7/2011 | Xiaobin |
| 7,992,259 | B2 | 8/2011 | Goldstein et al. |
| 8,087,269 | B2 | 1/2012 | Conti et al. |
| 8,122,744 | B2 | 2/2012 | Conti et al. |
| 8,144,014 | B1 | 3/2012 | Yang |
| 8,228,192 | B2 | 7/2012 | Eckert et al. |
| 8,274,391 | B2 | 9/2012 | Yang |
| 8,281,626 | B2 | 10/2012 | Conti et al. |
| 8,305,219 | B2 | 11/2012 | Yang |
| 8,341,985 | B2 | 1/2013 | Ezzo et al. |
| 8,347,663 | B2 | 1/2013 | Fawcett et al. |
| 8,368,542 | B2 | 2/2013 | Yang |
| 8,368,543 | B2 | 2/2013 | Yang |
| 8,373,565 | B2 | 2/2013 | Yang |
| 8,373,566 | B2 | 2/2013 | Yang |
| 8,375,524 | B2 | 2/2013 | Goldstein et al. |
| 8,408,472 | B2 | 4/2013 | Yang |
| 8,499,595 | B2 | 8/2013 | Zhang et al. |
| 8,599,022 | B2 | 12/2013 | Conti et al. |
| 8,640,509 | B2 | 2/2014 | Will |
| 8,773,267 | B2 | 7/2014 | Conti et al. |
| 8,800,330 | B2 | 8/2014 | Fawcett et al. |
| 8,890,689 | B2 | 11/2014 | Ezzo et al. |
| 8,938,997 | B2 | 1/2015 | Piccoli et al. |
| 2002/0129628 | A1 | 9/2002 | Skalberg |
| 2006/0157607 | A1* | 7/2006 | Kohlndorfer ..... B60R 22/4633 242/374 |
| 2007/0131005 | A1 | 6/2007 | Clare |
| 2007/0152819 | A1* | 7/2007 | Marszalek ..... G08B 13/1409 340/568.4 |
| 2008/0226421 | A1* | 9/2008 | Rudduck ..... B64D 11/06 411/356 |
| 2009/0058643 | A1* | 3/2009 | Groth ..... G08B 13/128 340/568.1 |
| 2009/0322531 | A1 | 12/2009 | Estevez et al. |
| 2010/0231388 | A1 | 9/2010 | Shute et al. |
| 2010/0315237 | A1 | 12/2010 | Yang |
| 2011/0094274 | A1 | 4/2011 | Conti et al. |
| 2011/0260594 | A1 | 10/2011 | Yang |
| 2012/0019383 | A1* | 1/2012 | Fawcett ..... G08B 13/1463 340/568.1 |
| 2012/0047972 | A1* | 3/2012 | Grant ..... A47F 3/002 70/77 |
| 2012/0050042 | A1 | 3/2012 | Shute et al. |
| 2012/0085134 | A1 | 4/2012 | Ezzo et al. |
| 2012/0210755 | A1 | 8/2012 | Shafer |
| 2012/0227446 | A1 | 9/2012 | Shute et al. |
| 2012/0227447 | A1* | 9/2012 | Conti ..... E05B 45/005 70/15 |
| 2012/0267436 | A1 | 10/2012 | Yang |
| 2012/0318027 | A1 | 12/2012 | Shute et al. |
| 2013/0067968 | A1 | 3/2013 | Ezzo |
| 2013/0098122 | A1 | 4/2013 | Eckeret et al. |
| 2013/0255335 | A1* | 10/2013 | Jonely ..... E05B 47/0001 70/277 |
| 2014/0266729 | A1 | 9/2014 | Perreau et al. |
| 2014/0318192 | A1 | 10/2014 | Conti et al. |
| 2014/0345336 | A1* | 11/2014 | Fawcett ..... E05B 45/005 70/58 |

OTHER PUBLICATIONS

Extended European Search Report from corresponding EP Application No. 14861894.5, dated Oct. 6, 2016 (9 pages).

* cited by examiner

WRAP FOR AN ITEM OF MERCHANDISE

CROSS REFERENCE TO RELATED APPLICATIONS

This United States non-provisional application claims the benefit of priority to U.S. Provisional Application No. 61/905,477 filed on Nov. 18, 2013, and U.S. Provisional Application No. 61/936,526 filed on Feb. 6, 2014, the entire disclosures of which are incorporated herein by reference.

FIELD OF THE INVENTION

Embodiments of the present invention relate generally to merchandise security systems and methods for protecting an item of merchandise from theft. More particularly, embodiments of the present invention relate to merchandise security devices configured for use with an electronic key.

BACKGROUND OF THE INVENTION

It is common practice for retailers to store and/or display relatively expensive items of merchandise on or within a merchandise security device, such as a security display (e.g. alarming stand), security fixture (e.g. locking hook, shelf, cabinet, etc.) or security packaging (e.g. merchandise keeper). Regardless, the merchandise security device stores and/or displays an item of merchandise so that a potential purchaser may view, and in some instances, interact with the merchandise before making a decision whether to purchase the item. At the same time, the item is secured on or within the merchandise security device so as to prevent, or at least deter, theft of the item. The value of the item, however, may make it an attractive target for a shoplifter despite the presence of a merchandise security device. A determined shoplifter may attempt to detach the item from the security display, or to remove the item from the security fixture or from within the security packaging. Alternatively, the shoplifter may attempt to remove all or a portion of the merchandise security device from the display area along with the item of merchandise.

SUMMARY OF THE INVENTION

In one aspect, the invention is embodied by a merchandise security device for securing an item of merchandise from theft. The security device includes a housing operably coupled with a cable that is configured to be extended and retracted relative to the housing and to at least partially surround an item of merchandise. The security device further includes a lock mechanism configured to releasably secure the cable relative to the housing for locking the cable about the item of merchandise. The lock mechanism is configured to receive electrical power for unlocking the lock mechanism so that the housing and the cable may be removed from the item of merchandise.

In another embodiment, a merchandise security device for securing an item of merchandise from theft is provided. The merchandise security device includes a housing operably coupled with a cable, wherein the cable is configured to be extended and retracted relative to the housing. The cable is a single loop and is configured to at least partially surround each side of an item of merchandise. The security device also includes a lock mechanism configured to releasably secure the cable relative to the housing for locking the cable about the item of merchandise.

In another aspect, the invention is embodied by a merchandise security system for securing an item of merchandise from theft. The merchandise security system includes an electronic key and a housing operably coupled with a cable. The cable is configured to be extended and retracted relative to the housing and to at least partially surround an item of merchandise. The security system further includes a lock mechanism configured to releasably secure the cable relative to the housing for locking the cable about the item of merchandise. The lock mechanism is configured to be operated by electrical power transferred from the electronic key to the lock mechanism. The lock mechanism is operably engaged with a shape memory material, and the shape memory material is configured to change in shape in response to receiving electrical power from the electronic key to thereby lock or unlock the lock mechanism so that the housing and the cable may be removed from the item of merchandise.

In yet another aspect, the invention is embodied by a method for securing an item of merchandise from theft. The method includes positioning a housing adjacent to an item of merchandise, the housing operably coupled with a cable. The method further includes at least partially surrounding the item of merchandise with the cable. The method further includes engaging a lock mechanism for releasably securing the cable relative to the housing such that the cable is locked about the item of merchandise. The method further includes actuating the lock mechanism with electrical power to unlock the lock mechanism to facilitate removal of the housing and the cable from the item of merchandise.

BRIEF DESCRIPTION OF THE DRAWINGS

The detailed description of the invention provided hereafter may be better understood with reference to the accompanying drawing figures, which depict embodiments of merchandise security systems and methods for protecting retail display merchandise from theft.

DETAILED DESCRIPTION OF EMBODIMENTS OF THE INVENTION

Figure 1:
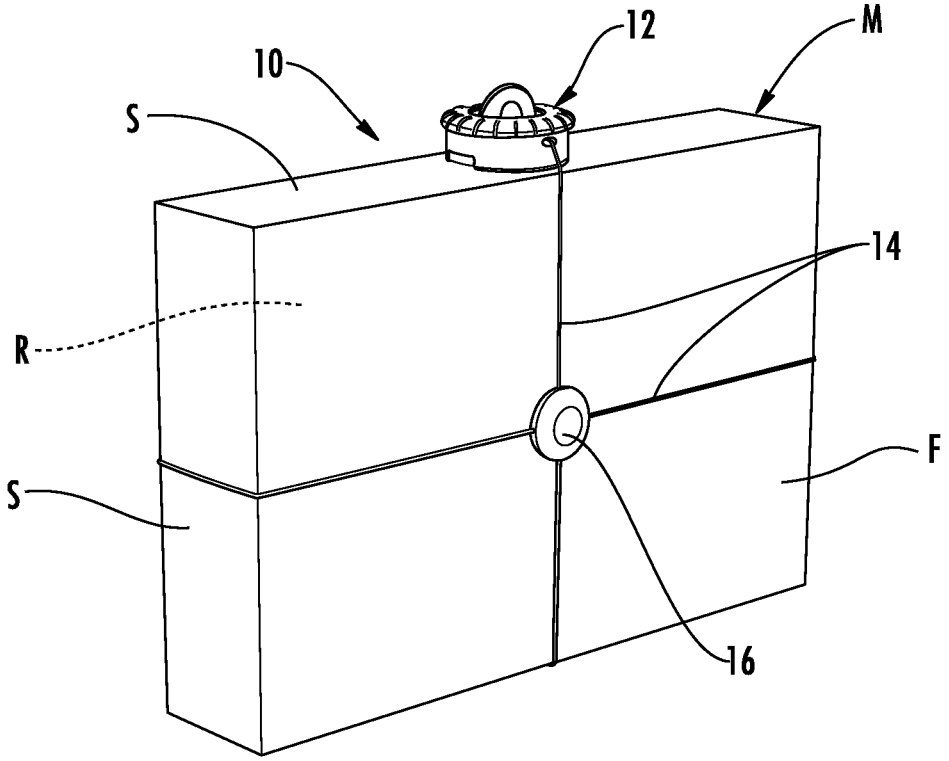
FIG. 1 is a perspective view showing an embodiment of a merchandise security device configured to cooperate with an electronic key for locking and/or unlocking a lock mechanism according to the invention.

Referring now to the accompanying drawing figures wherein like reference numerals denote like elements throughout the various views, one or more embodiments of a merchandise security system are shown. In the embodiments shown and described herein, the merchandise security system includes an electronic key and a merchandise security device. In some embodiments shown and described herein, the merchandise security device is employed for securing items of merchandise from theft. For example, the merchandise security device may be suitable for use with a variety of different items merchandise, including packages containing items of merchandise. The item of merchandise may be any desired shape, such as a box-like structure.

The electronic key may be useable with any security device that utilizes power transferred from the key to operate a lock mechanism associated with the security device and/or utilizes data transferred from the key to authorize the operation of the lock mechanism and an optional alarm circuit. In other words, an electronic key according to embodiments of the invention is useable with any security device or lock mechanism that requires power transferred from the key to the device and/or data transferred from the key to the device. It should be noted that although the invention is described with respect to embodiments including an electronic key for transferring both data and electrical power to a security device to operate a mechanical lock mechanism, the invention is equally applicable to an electronic key for transferring only electrical power to a security device to operate any component of the security device (e.g., a lock mechanism), whether or not the security device includes an internal or external power source for operating another component of the device.

Figure 2:
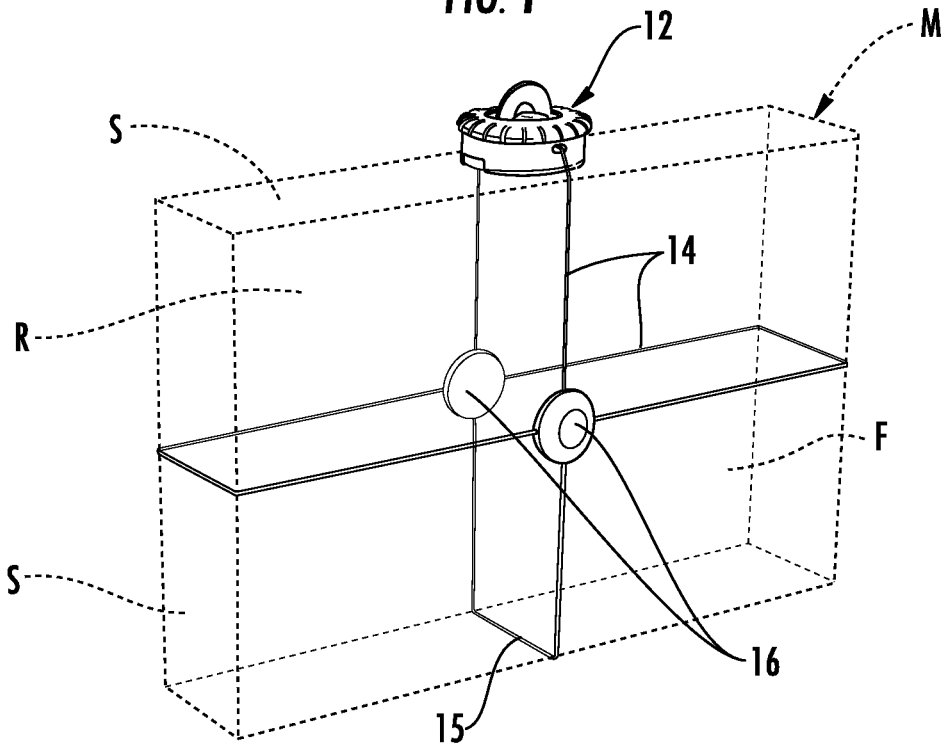
FIG. 2 is a perspective view of the merchandise security device of FIG. 1 including a stabilizing member shown with the item of merchandise depicted in phantom for purposes of clarity.
Figure 3:
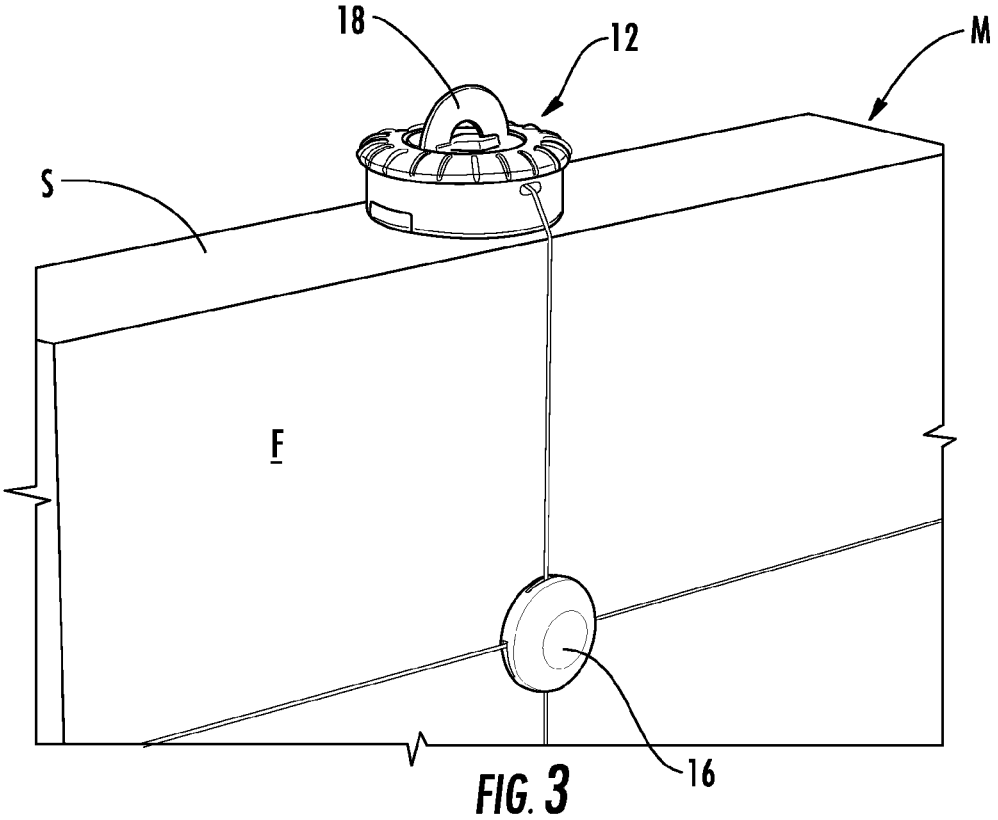
FIG. 3 is an enlarged partial perspective view of the merchandise security device and stabilizing member of FIG. 1 showing a hang tag in greater detail.

One embodiment of a merchandise security system and method according to the invention is illustrated in FIGS. 1-3, which is explained in further detail below. The embodiment of the merchandise security system and method depicted comprises a merchandise security device that is configured to be operated by an electronic key. The system and method may further comprise an optional programming station that is operable for programming the key with a security code, which is also referred to herein as a Security Disarm Code (SDC). A programming station suitable for use with the present invention is shown and described in detail in U.S. Pat. No. 7,737,844 entitled PROGRAMMING STATION FOR A SECURITY SYSTEM FOR PROTECTING MERCHANDISE, the disclosure of which is incorporated herein by reference in its entirety. It is understood that in other embodiments, the electronic key may be programmed without use of a programming station. For example, the key may be self-programming, or alternatively, could be pre-programmed with a predetermined security code.

In addition to a programming station, the system and method may further comprise an optional charging station that is operable for initially charging and/or subsequently recharging a power source disposed within the key. The electronic key may be provisioned with a single-use (i.e. non-rechargeable) power source, such as a conventional or extended-life battery. Alternatively, the key may be provisioned with a multiple-use (i.e. rechargeable) power source, such as a conventional capacitor or rechargeable battery. In either instance, the power source may be permanent, semi-permanent (i.e. replaceable), or rechargeable, as desired. In the latter instance, charging station is provided to initially charge and/or to subsequently recharge the power source provided within the electronic key.

In one embodiment, the merchandise security device is a passive device. As used herein, the term "passive" is intended to mean that the security device does not have an internal power source (e.g., a battery) sufficient to lock and/or unlock a mechanical lock mechanism. Significant cost savings are obtained by a retailer when the merchandise security device is passive since the expense of an internal power source is confined to the electronic key, and one such key is operable for providing electrical power to multiple different merchandise security devices. In addition, the merchandise security device may not require an electric motor, such as a DC stepper motor, solenoid, or the like, that is configured to lock or unlock the lock mechanism. As such, the merchandise security device may employ a simplified lock mechanism that does not require various components operated by an internal source of electrical power.

Moreover, in some embodiments the merchandise security device is not required to include a logic control circuit, while the electronic key includes such a logic control circuit. In this regard, some merchandise security devices include a logic control circuit adapted to perform a handshake communication protocol with the logic control circuit of the key (e.g., using an SDC). Thus, the merchandise security device may not include a logic control circuit used to communicate with the electronic key in order to confirm that the merchandise security device is an authorized device. Likewise, the electronic key may also not include a logic control circuit. Regardless of whether the electronic key includes a logic control circuit, an SDC may be unnecessary when the electronic key is configured to transmit power to the security device in a manner that is not readily duplicated by a potential thief. For example, where the electronic key is configured to transmit power inductively, the inductive signature may provide increased security relative to conventional mechanical locks that utilize mechanical or magnetic actuators. For example, the electronic key may be configured to transmit an inductive signature including a particular amplitude and/or frequency of a power signal that is not readily apparent or able to be easily duplicated.

In one embodiment, the electronic key does not transmit an SDC to the merchandise security device. However, in other embodiments, the electronic key may be configured to transmit an SDC to the merchandise security device. In this example, the merchandise security device may include a corresponding SDC. Thus, the electronic key may be configured to perform a handshake communication protocol with the merchandise security device. Where the SDC of the electronic key matches the SDC of the merchandise security device, the electronic key may then be operable to transmit electrical power to the security device.

However, in other embodiments the merchandise security device may not recognize the SDC transmitted by the electronic key, such as where the security device does not include a logic control circuit or a component including an SDC. If the electronic key does not receive a return signal from the merchandise security device, the electronic key may then transmit electrical power to the security device as described in further detail below. Thus, although the electronic key may transmit an SDC to the merchandise security device, the security device may not recognize the SDC and the SDC transmitted by the electronic key will not affect the operation of the security device. As will be readily apparent to those skilled in the art, the SDC may be transmitted from the electronic key to the merchandise security device by any suitable means, including without limitation, via one or more electrical contacts, or via optical, acoustic, electromechanical, electromagnetic or magnetic conductors, as desired. Furthermore, the SDC may be transmitted by inductive transfer of data from the electronic key to a programmable merchandise security device.

In one embodiment, the logic control circuit of the electronic key is configured to cause the internal power source of the key to transfer electrical power to the merchandise security device to operate a lock mechanism of the merchandise security device. In one embodiment, electrical contacts disposed on the electronic key electrically couple with cooperating electrical contacts on the merchandise security device to transfer power from the internal battery of the key to the merchandise security device. Power may be transferred directly to the lock mechanism via one or more conductors. For example, a conductor may be coupled to a mechanical lock mechanism, and when electrical power is conducted through the conductor, a state change occurs thereby resulting in operation of the lock mechanism. In one example, the conductor is coupled to a shape memory material (e.g., Nitinol) such that electrical power transferred through the conductor results in a change in shape of the shape memory material. Such a change in shape may cause a mechanical actuation (e.g., linear or rotary) of the lock mechanism to thereby lock or unlock the lock mechanism. In other embodiments, the lock mechanism may cooperate with a motor or solenoid for operating the lock mechanism.

An available feature of a merchandise security system and method according to an embodiment of the invention is that the electronic key may include a time-out function. More particularly, the ability of the electronic key to transfer power and/or data to the merchandise security device is deactivated after a predetermined time period. By way of example, the logic control circuit of the electronic key may be deactivated after about six to twelve hours (e.g., about eight hours) from the time the key was fully charged or programmed, or was last refreshed by the programming station. In this manner, an authorized sales associate typically must program or refresh the electronic key assigned to him at the beginning of each work shift. Furthermore, the charging station may be configured to deactivate the logic control circuit of the electronic key when the key is positioned within the charging station. In this manner, the charging station can be made available to an authorized sales associate in an unsecured location without risk that a charged key could be removed from the charging station and used to maliciously disarm and/or unlock a merchandise security device. The electronic key would then have to be charged, programmed or refreshed by the programming station, which is typically monitored or maintained at a secure location, in order to reactivate the logic control circuit of the key.

The merchandise security device may include a transfer port sized and shaped to receive a transfer probe of the electronic key. At least one, and sometimes, a plurality of magnets may be disposed within the transfer port of the merchandise security device for securely positioning and retaining the transfer probe of the key in electrical contact with electrical contacts of the mechanical lock mechanism. Power is transferred from the electronic key to the lock mechanism of the merchandise security device through electrical contacts disposed on the transfer probe of the key and corresponding electrical contacts disposed within the transfer port of the merchandise security device.

In another embodiment, a merchandise security system and method comprise an electronic key with inductive transfer, and a merchandise security device that is operated by the key. However, the electronic key is useable with any security device or locking device with inductive transfer capability that requires power transferred from the key to the device by induction, or alternatively, requires data transferred between the key and the device and power transferred from the key to the device by induction.

In one embodiment, the merchandise security device comprises an internal lock mechanism. A transfer port may be formed in the merchandise security device that is sized and shaped to receive a transfer probe of the electronic key. If desired, the transfer port may comprise mechanical or magnetic means for properly positioning and securely retaining the transfer probe of the electronic key within the transfer port of the merchandise security device. However, in one embodiment, it is only necessary that the inductive transceiver of the electronic key is sufficiently aligned with or proximate to the corresponding inductive transceiver of the merchandise security device, or proximate to the transfer port. Therefore, magnets are not required to position, retain and/or maintain electrical contacts provided on the electronic key in electrical contact with corresponding electrical contacts provided on the merchandise security device. In the embodiments shown and described herein, data and/or power is transferred from the electronic key to the merchandise security device by wireless communication, such as infrared (IR) optical transmission. Power may be transferred from the electronic key to the merchandise security device by induction across the transfer port of the security device using an inductive transceiver disposed within a transfer probe of the key that is aligned with a corresponding inductive transceiver disposed within the security device. For example, the transfer probe of the electronic key may comprise an inductive transceiver coil that is electrically connected to the logic control circuit of the key to provide electrical power from the internal battery of the key to an inductive transceiver coil disposed within the security device. The inductive transceiver coil of the merchandise security device may then transfer the electrical power from the internal battery of the key to the lock mechanism disposed within the security device. Thus, the merchandise security device may include at least one conductor configured as a coil having a plurality of continuous windings. As previously mentioned, the power transferred from the key may be used to unlock the lock mechanism without the addition of various other electrically powered mechanisms, for example, an electric motor, DC stepper motor, solenoid, or the like.

In some embodiments generally discussed above, a shape memory material may be employed, such as for use in conjunction with inductive power transfer. The shape memory material may be in electrical communication with the inductive coil and is configured to change in shape in response to electrical current being transmitted through the shape memory material. A change in shape of the shape memory material may, in turn, result in actuation of the lock mechanism. As such, the merchandise security device may also not require a rectifier for converting the alternating current into direct current for operating the lock mechanism. In this regard, some merchandise security devices require that the alternating current induced in an inductive coil be transformed into a direct current, such as via a bridge rectifier or a logic control circuit, to provide direct current (DC) power to the security device. Such a conversion is not required by embodiments of the present invention, as the alternating current may be used to actuate the lock mechanism. Indeed, the merchandise security device may also not require a battery, motor, solenoid, and/or any other electrical component as discussed above. Therefore, the lock mechanism is simplified for use with a variety of different merchandise security devices.

Figure 20:
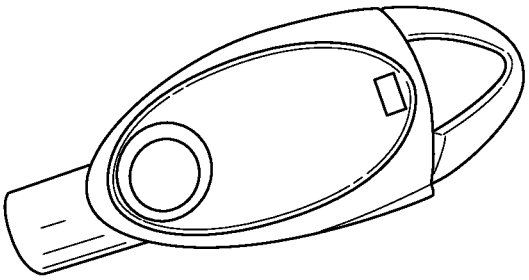
FIG. 20 is a perspective view of an embodiment of an electronic key configured for use with a merchandise security device according to the invention.

Turning now to exemplary embodiments of the present invention, FIGS. 1-3 illustrate an embodiment of a merchandise security device 10 configured to cooperate with an electronic key (see, e.g., FIG. 20) for locking and/or unlocking a lock mechanism. In some embodiments, the electronic key is also configured to arm and/or disarm an alarm circuit contained within the merchandise security device 10. FIG. 1 shows that the merchandise security device 10 generally includes a housing 12 operably coupled with a cable 14. As shown, the cable 14 is configured to extend at least partially about an item of merchandise M. Where the item of merchandise M is a six-sided item (e.g., a box), the cable 14 is configured to extend about the front F and rear R sides of the item, as well as about at least a pair of opposed lateral sides S of the item. The housing 12 is configured to be positioned adjacent to one of the lateral sides S of the item of merchandise M, such as on the top side of the item of merchandise. Thus, the housing 12 does not detract from the presentation of the item of merchandise M, which is unlike conventional cable wraps that require the security device to be positioned on one of the major surfaces of the item of merchandise, which may hinder the visibility of relevant information, as well as hinder the ability to stack items of merchandise adjacent to one another in a compact manner.

Figure 12:
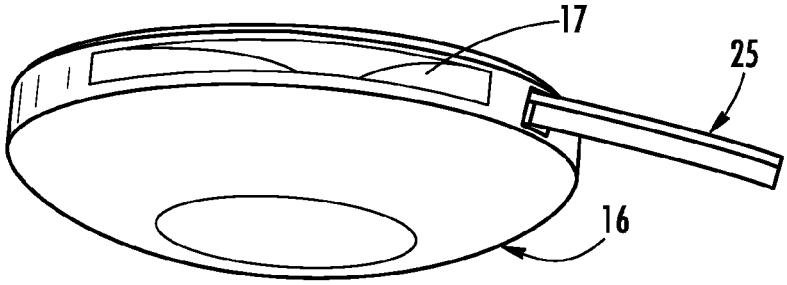
FIG. 12 is a perspective view of an embodiment of a stabilizing member configured for use with a merchandise security device according to the invention.
Figure 13:
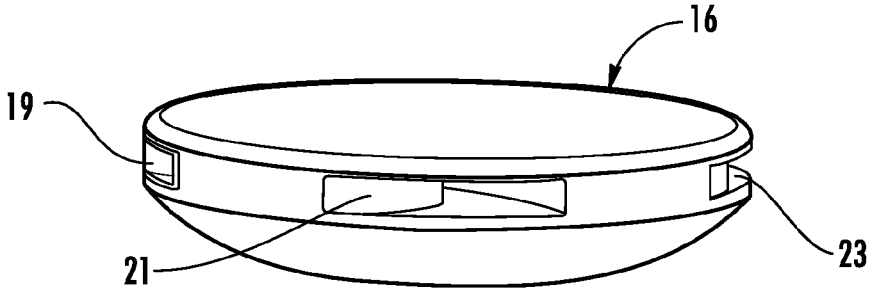
FIG. 13 is a perspective view of another embodiment of a stabilizing member configured for use with a merchandise security device according to the invention.
Figure 14:
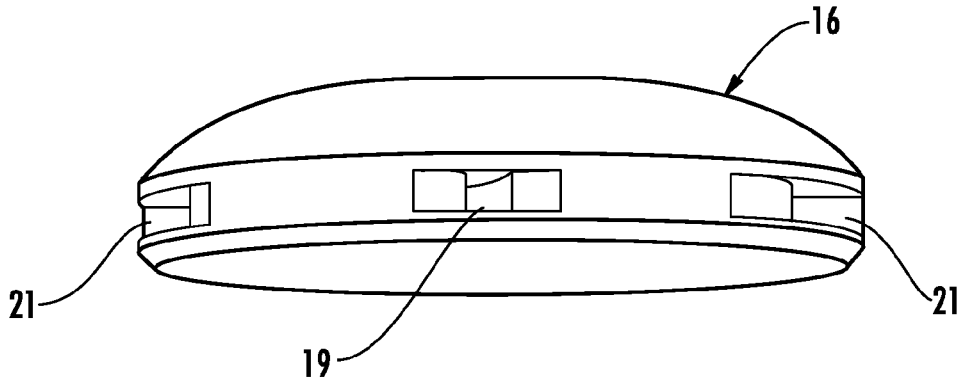
FIG. 14 is another perspective view of the stabilizing member shown in FIG. 13.
Figure 22:
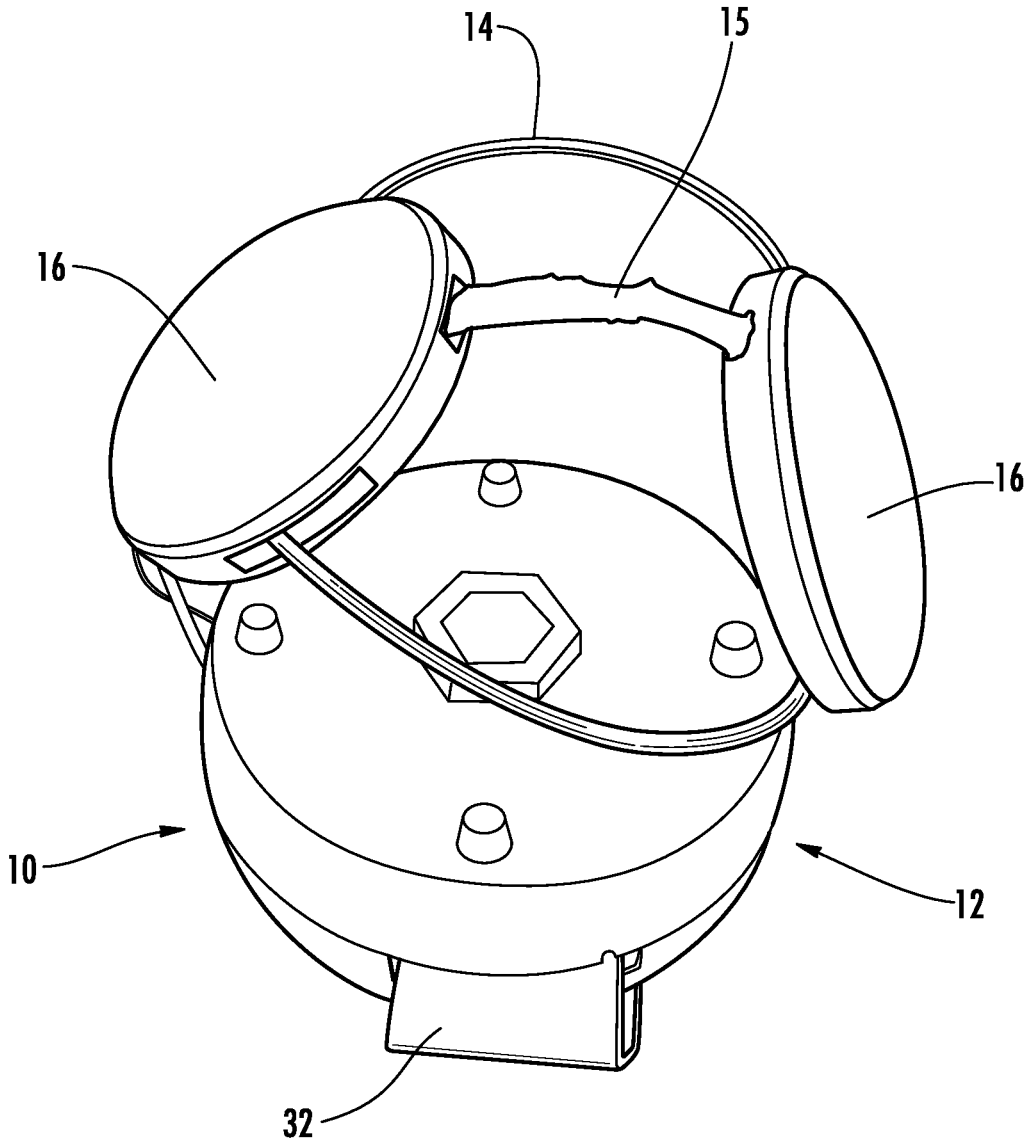
FIG. 22 is a perspective view illustrating an exemplary embodiment of a merchandise security device for securing a merchandise security device to an item of merchandise.
Figure 23:
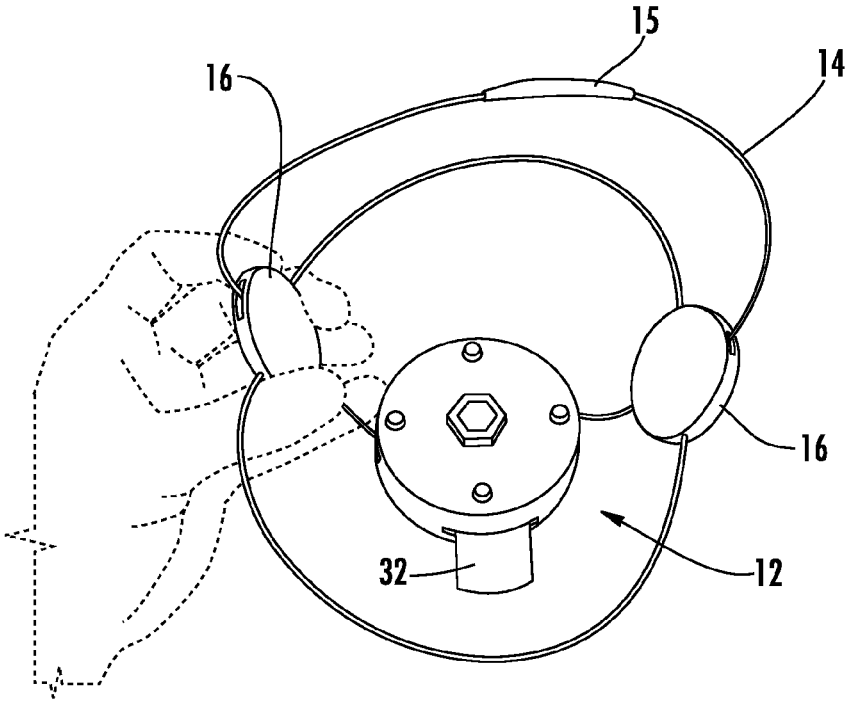
FIG. 23 is another perspective view illustrating the merchandise security device of FIG. 22.
Figure 24:
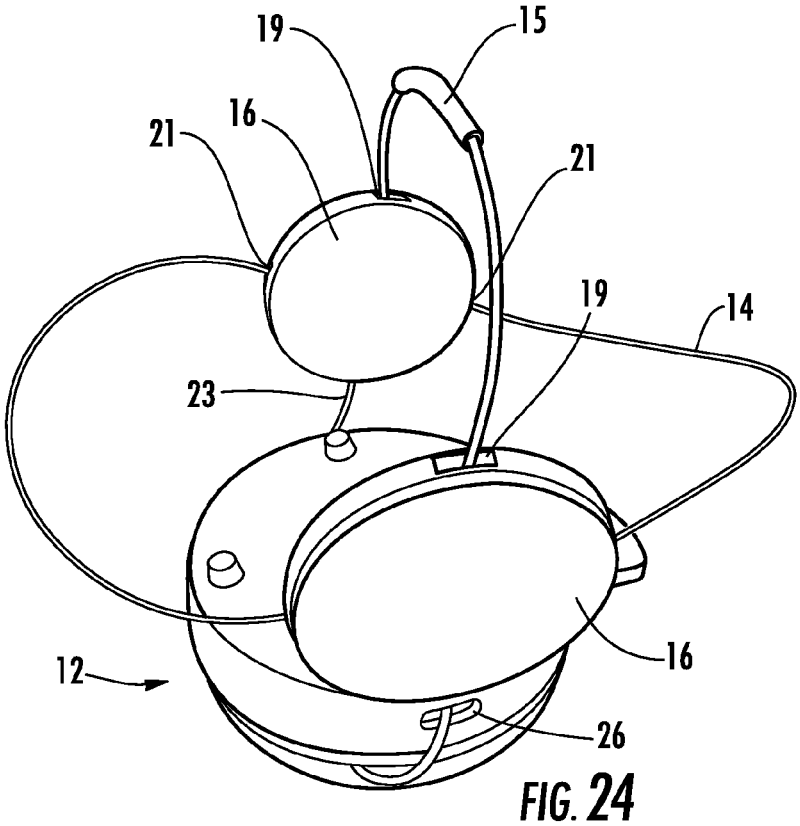
FIG. 24 is another perspective view illustrating the merchandise security device of FIG. 22.

FIG. 2 shows that the merchandise security device 10 may include a pair of stabilizing members 16, wherein the cable 14 is configured to be routed through each of the stabilizing members. The stabilizing members 16 may be configured to be positioned on opposite sides of one another, such as the front F and rear R sides of the item of merchandise M. FIGS. 12-14 illustrate an embodiment of a stabilizing member 16 that includes a plurality of slots 17 configured to receive the cable 14. The slots 17 may include radiuses for reducing friction on the cable 14 as the cable passes through. FIGS. 22-24 show an embodiment of a merchandise security device 50 including stabilizing members 16 with slots 17. The slots are particularly arranged to reduce friction as the cable 14 is unwound from the housing 12 and the stabilizing members 16 are displaced away from one another. As best shown in FIG. 13, each stabilizing member 16 may include at least one slot 19 that does not include a radius, at least a pair of slots 21 that include one radius, and at least one slot 23 that includes a pair of radiuses. Unlike conventional cable wraps, the merchandise security device 10, 50 does not require locking stabilizing members 16. Thus, only the housing 12 comprises a lock mechanism, while the stabilizing members 16 are used to position the merchandise security device 10, 50 on the item of merchandise M and to secure the cable 14 about the item of merchandise. However, it is understood that one or both of the stabilizing members 16 may be locking. For example, one or both stabilizing members 16 may include a lock mechanism 25 for further locking the cable 14 relative to the item of merchandise M (see, e.g., FIG. 12). Such a lock mechanism 25 may be employed, for example, to provide additional tension on the cable 14, as well as further security for preventing removal of the cable from the item of merchandise M. In one embodiment, the lock mechanism 25 may include a lock button configured to be inserted within the stabilizing member 16 for operable engaging the cable. The lock mechanism 25 may be configured to be unlocked only after the lock mechanism 30 has been unlocked.

Figure 4:
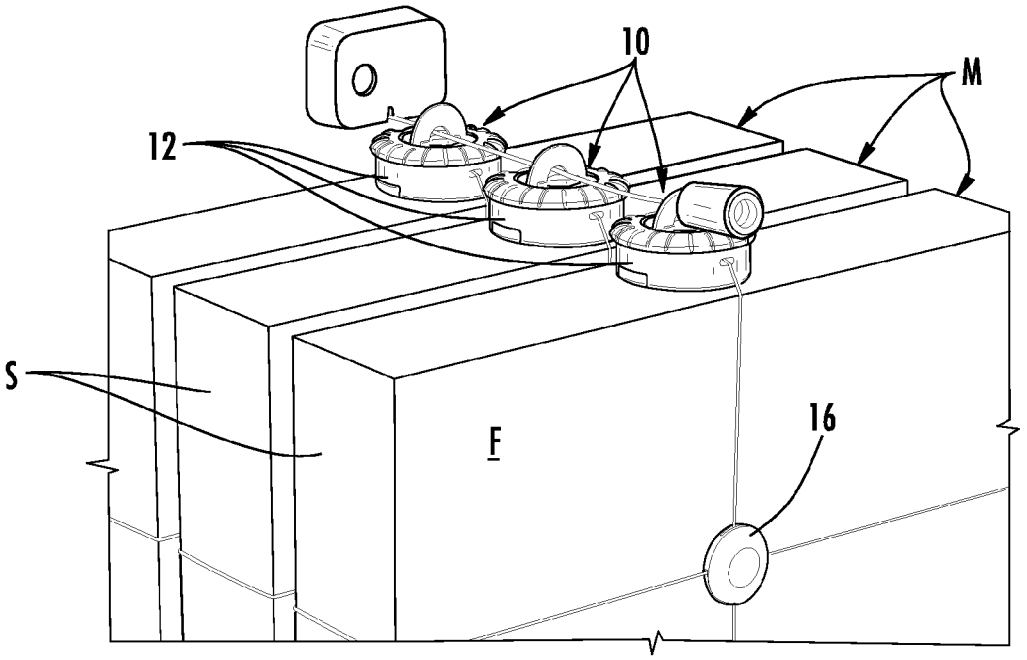
FIG. 4 is a partial perspective view showing a plurality of merchandise security devices each including a hang tag and disposed on a merchandise display fixture.
Figure 5:
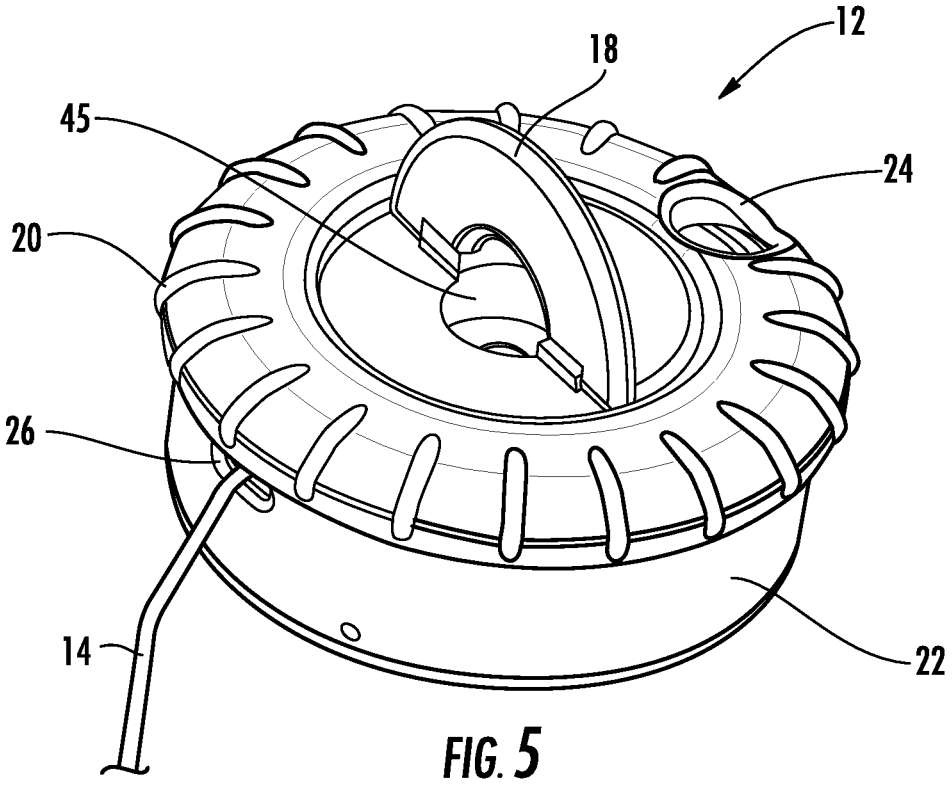
FIG. 5 is a perspective view of an exemplary embodiment of a housing of a merchandise security device according to the invention.
Figure 6:
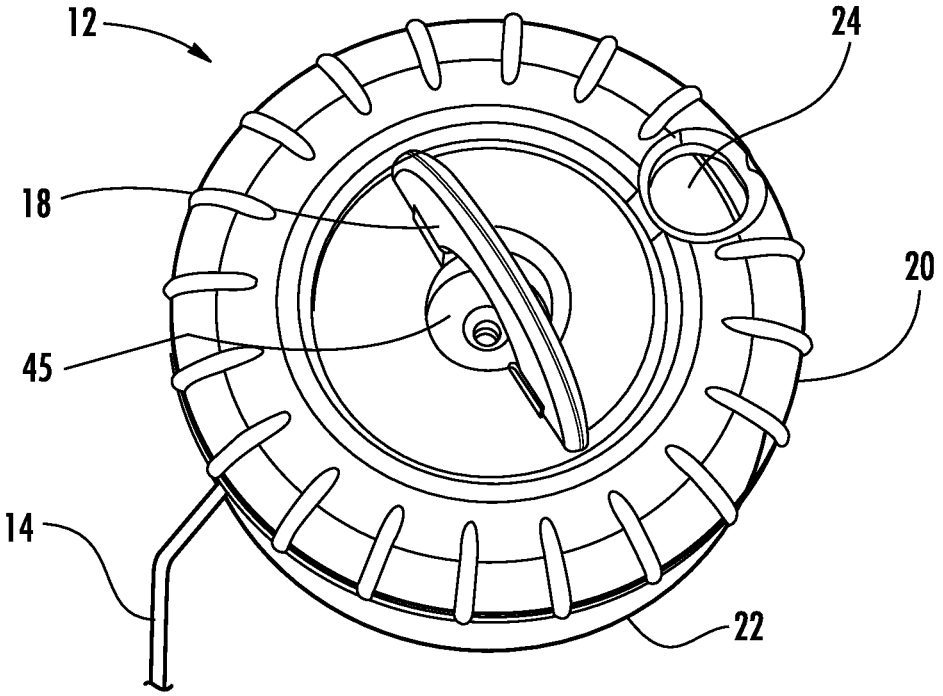
FIG. 6 is a top perspective view of the housing of the merchandise security device of FIG. 5.
Figure 15:
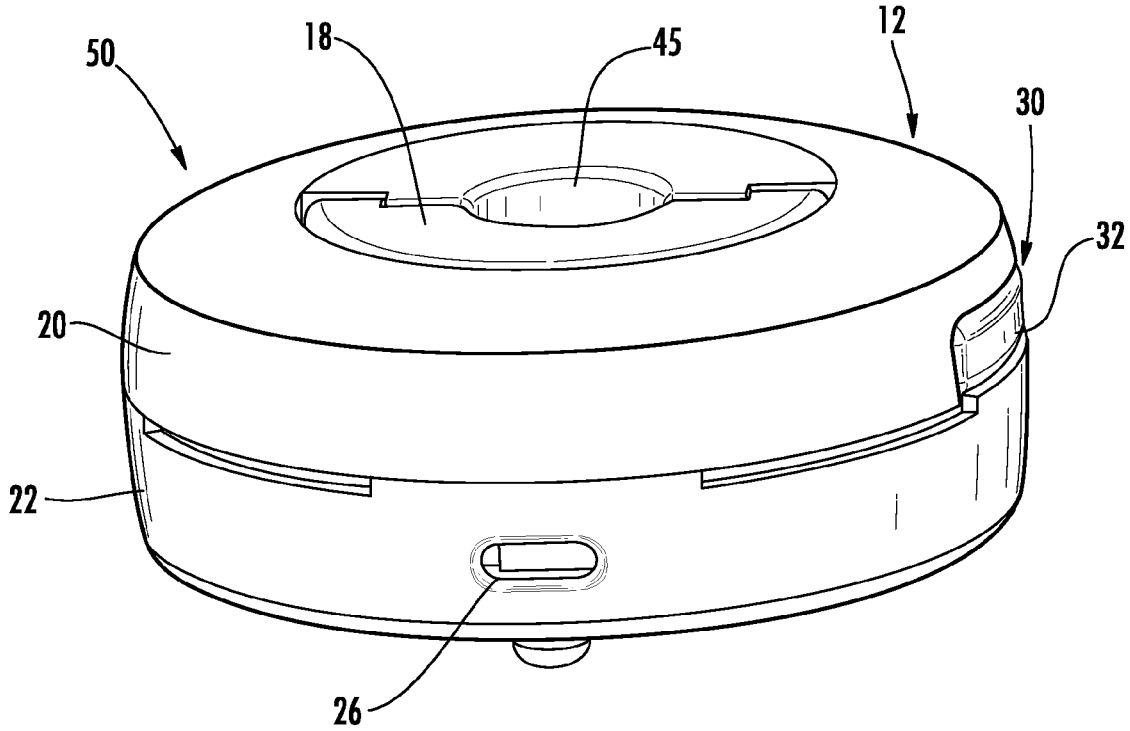
FIG. 15 is a perspective view showing another embodiment of a merchandise security device configured to cooperate with an electronic key for locking and/or unlocking a lock mechanism according to the invention.
Figure 16:
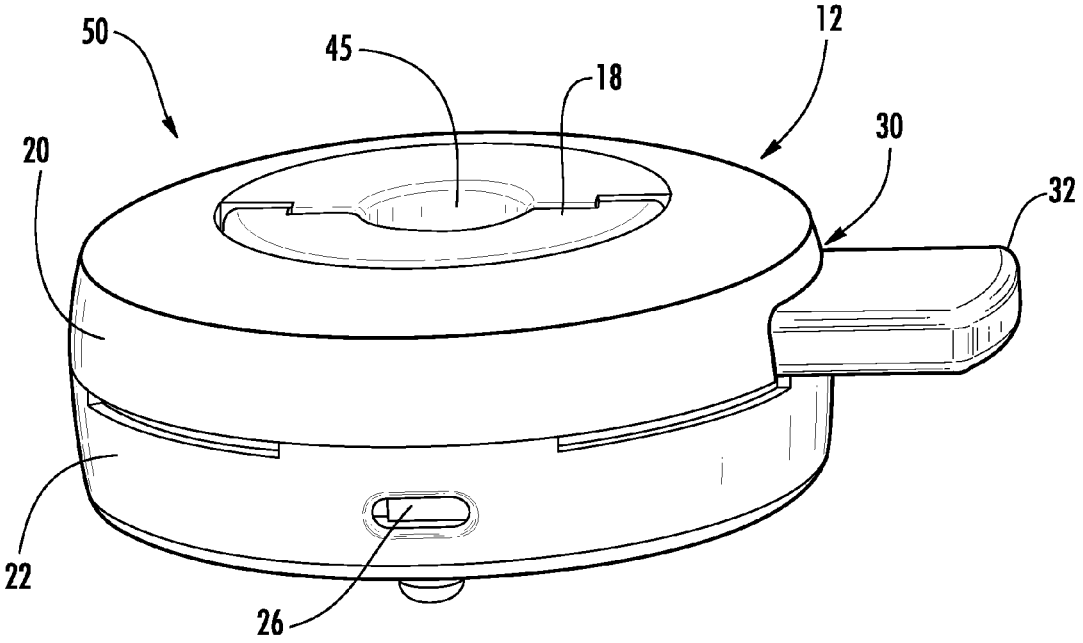
FIG. 16 is a perspective view of the merchandise security device of FIG. 15 showing the lock mechanism in an unlocked position.
Figure 17:
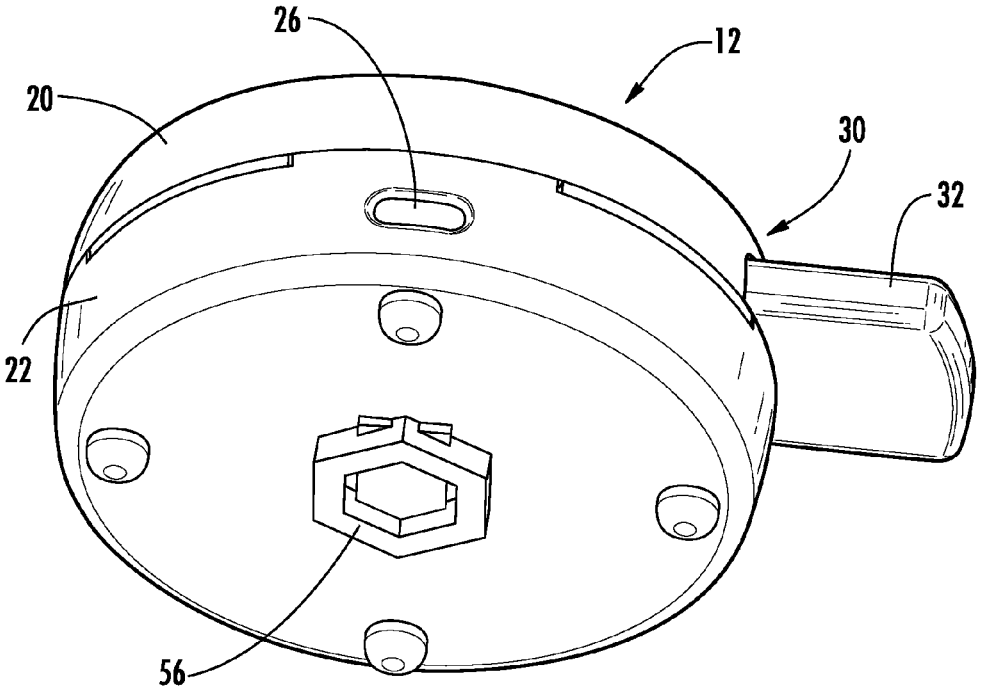
FIG. 17 is another perspective view of the merchandise security device of FIG. 15 showing the lock mechanism in the unlocked position.

The enlarged view of FIG. 3 shows that the housing 12 may include a hang tag 18. The hang tag 18 may define an opening configured to receive a tether, hook, or the like therethrough. Thus, the hang tag 18 may be configured to be used with secondary security features, such as locking hooks or locking tethers, as illustrated in FIG. 4. The hang tag 18 may be configured to pivot with respect to the housing 12, such that the hang tag may be unfolded and folded between use (see, e.g., FIG. 4) and non-use positions (see, e.g., FIG. 15), respectively.

The cable 14 may be flexible so as to be able to extend about and conform to the peripheral shape of the item of merchandise M. In some embodiments, the cable 14 includes at least one conductor for defining a sense loop therethrough. The housing 12 may contain an alarm circuit in communication with the sense loop that is configured to detect when the cable 14 has been cut, severed or removed from the housing. The alarm circuit may be configured to generate an audible and/or a visible alarm in response to interruption of the sense loop. In addition, the cable 14 may include a cut-resistant outer covering or sheath. Furthermore, the cable 14 may be a single continuous loop. In this regard, only one cable 14 is required to secure the housing 12 to the item of merchandise M. In some cases, each end of the cable 14 may be secured within the housing to form a single loop. FIGS. 1 and 2 show that the single loop of cable 14 may cooperate with the stabilizing members 16 for surrounding each side of the item of merchandise M. Thus, unlike conventional cable wraps, more than one cable 14 is not required, although it is possible that more than one cable could be used if desired.

Figure 9:
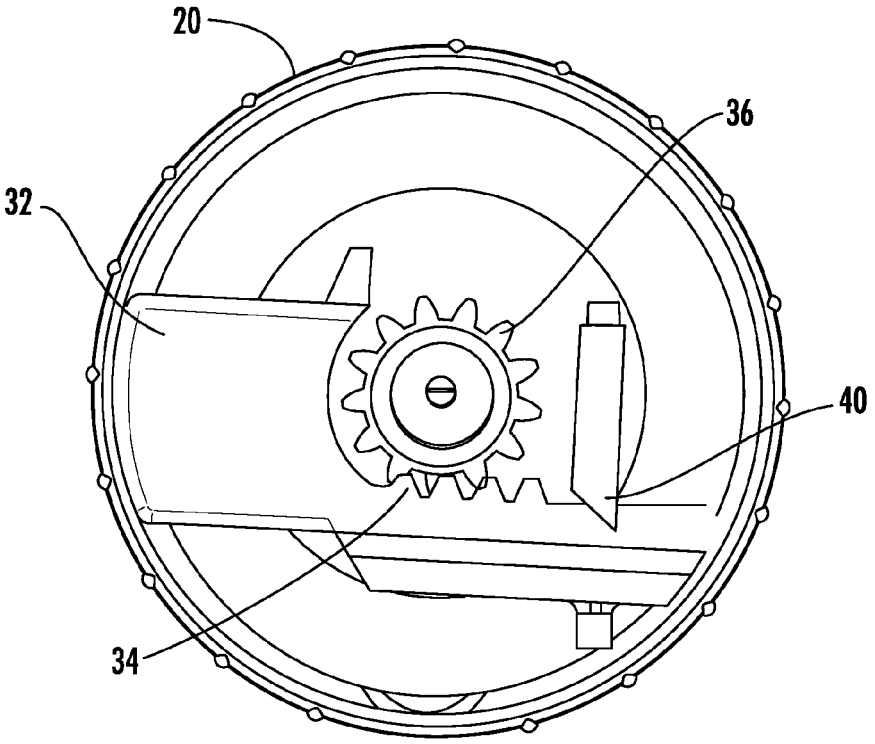
FIG. 9 is a bottom view of the housing of the merchandise security device of FIG. 5 with the bottom housing removed for purposes of clarity showing the lock mechanism in the locked position.
Figure 10:
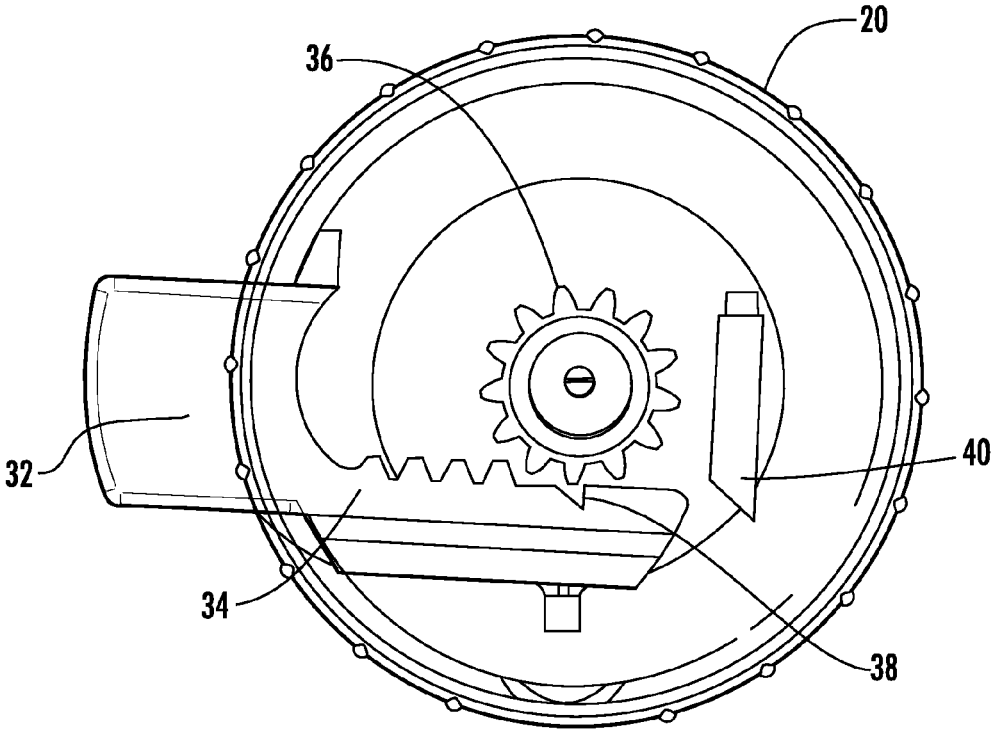
FIG. 10 is another bottom view of the housing of the merchandise security device of FIG. 5 with the bottom housing removed for purposes of clarity showing the lock mechanism in the unlocked position.
Figure 11:
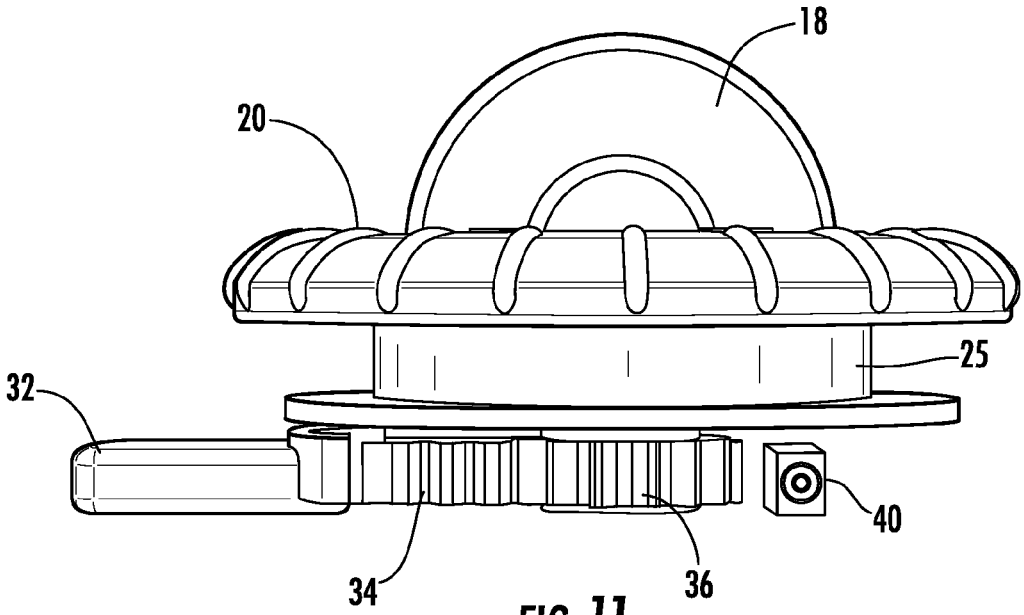
FIG. 11 is a side view of the housing of the merchandise security device of FIG. 5 with the bottom housing removed for purposes of clarity showing the lock mechanism in the unlocked position.

FIGS. 5-11 illustrate an exemplary embodiment of a housing 12 of a merchandise security device according to the invention. In this embodiment, the cable 14 is configured to be manually wound and unwound from the housing 12 for extending and retracting the cable relative to the housing. The housing 12 includes a reel 20 that is configured to be manually wound relative to a bottom housing 22. The reel 20 is rotatably coupled to the bottom housing 22, such that the reel may be rotated clockwise or counterclockwise relative to the bottom housing. Thus, the cable 14 may be configured to be tightened around an item of merchandise M for securing the housing 12 to the item of merchandise and to be loosened for removing the housing and cable from the item of merchandise. The reel 20 may include a textured outer surface for facilitating rotation of the reel relative to the bottom housing 22. The reel 20 could also in addition, or alternatively, include a hole 24 configured to receive a user's finger for manually rotating the reel in a clockwise or counterclockwise direction. In addition, FIG. 11 shows that the reel 20 may include a spool 25 for receiving the cable 14, wherein the cable may be wound and unwound from the spool. The bottom housing 22 may define a plurality of openings 26 configured to receive the cable therethrough. In one example, the bottom housing 22 includes a pair of openings 26 that are disposed radially opposite one another. The cable 14 may be configured to be displaced through each of the openings 26 as the cable is tightened and loosened.

Figure 7:
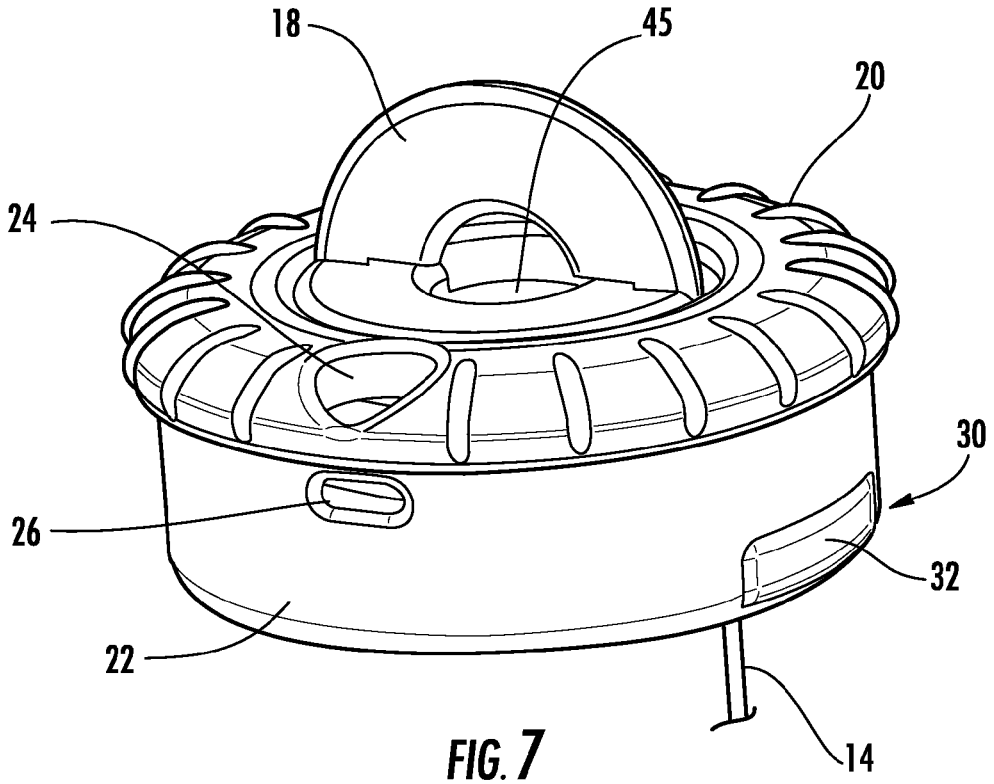
FIG. 7 is a side perspective view of the housing of the merchandise security device of FIG. 5 illustrating a lock mechanism in a locked position.
Figure 8:
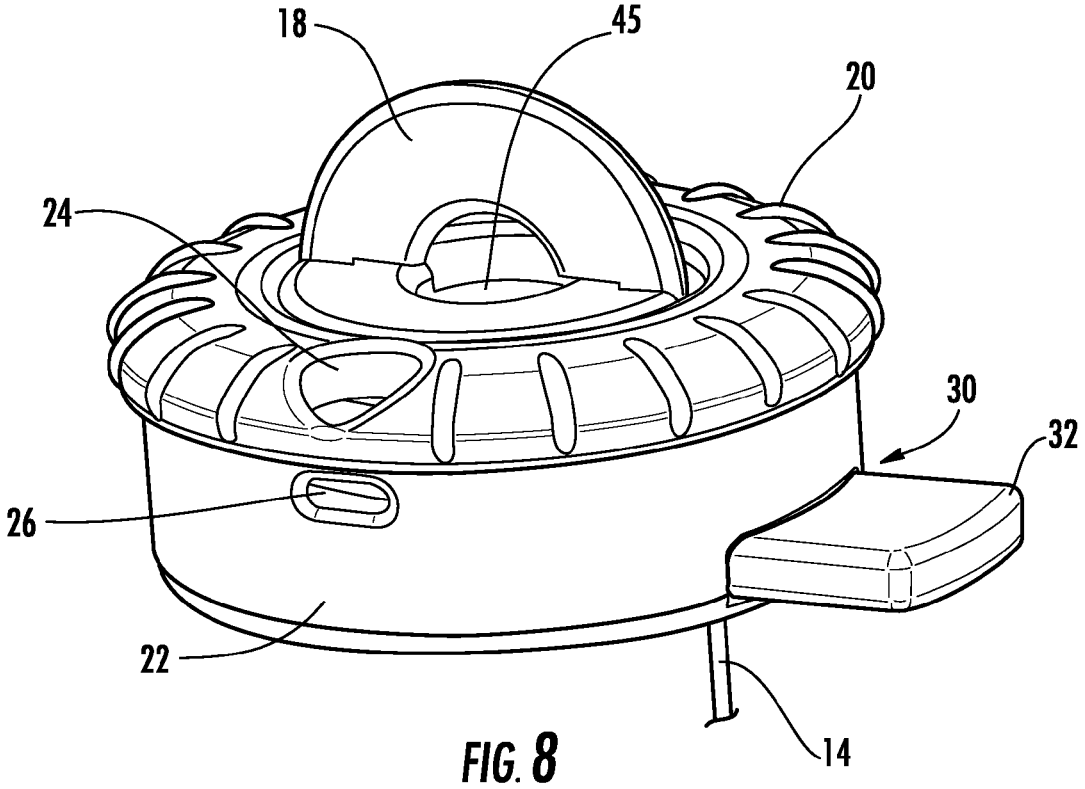
FIG. 8 is another side perspective view of the housing of the merchandise security device of FIG. 5 illustrating the lock mechanism in an unlocked position.

FIGS. 7 and 8 show the housing 12 of the merchandise security device 10 further includes a lock mechanism 30. The lock mechanism 30 may include a lock button 32 that is configured to be moved between a locked position (see, e.g., FIG. 7) and an unlocked position (see, e.g., FIG. 8). In the illustrated example, the lock button 32 is configured to be moved outwardly to the unlocked position and inwardly within the housing 12 to the locked position. In the locked position, the cable 14 may be locked relative to the housing 12 such that the cable is unable to be withdrawn out of the housing or retracted into the housing. Notably, the lock mechanism 30 does not require complicated assemblies, such as ratchet mechanisms, for winding, unwinding, or locking the cable 14.

FIGS. 9-11 illustrate the lock mechanism 30 in more detail, wherein the bottom housing 22 has been removed for purposes of clarity. In this embodiment, the lock button 32 includes a rack 34 that is configured to operably engage a pinion 36, and also includes a notch 38 (see, FIG. 10) configured to engage a latch 40. The pinion 36 is operably engaged with the reel 20, and the notch 38 is configured to engage the latch 40 in the locked position. When the notch 38 is engaged with the latch 40, the pinion 36 is unable to be rotated such that the reel 20 is locked in position. FIG. 10 shows the lock button 32 in an unlocked position, whereby the latch 40 is disengaged from the notch 38. In other embodiments, it is noted that when the lock button 32 is moved from an unlocked position to a locked position, the rack 34 is configured to mate with the pinion 36 and to rotate the pinion until the latch 40 engages the notch 38. Rotation of the pinion 36 causes the cable 14 to retract into the housing 12. Thus, the lock button 32 may be configured to provide additional tension to the cable 14 as the lock button is moved from the unlocked position to the locked position. This tensioning could be used to "fine tune" the tension applied to the cable 14 about the item of merchandise M. The tension should be such that the merchandise security device 10 cannot be removed from the item of merchandise M, but should not be so great as to damage the item of merchandise.

Figure 21:
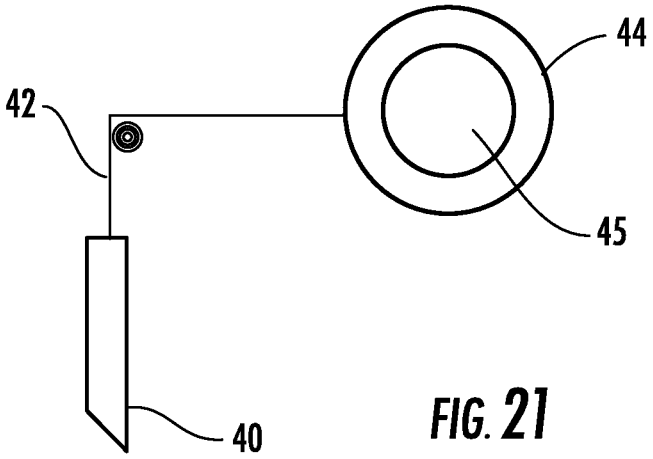
FIG. 21 is a schematic illustrating a transfer port for cooperating with the electronic key of FIG. 20 to provide electrical power to a shape memory material for actuating a latch of a lock mechanism.

The latch 40 may be operably engaged with a shape memory material 42. As discussed above, the shape memory material may be configured to be actuated in response to electrical power. In one embodiment, the reel 20 includes a transfer port 45 (e.g., FIGS. 5-8) that is operably engaged with at least one conductor 44, wherein the at least one conductor is electrically connected to the shape memory material (see, e.g., FIG. 21). Thus, the transfer port 45 is configured to receive electrical power from an electronic key (see, e.g., FIG. 20) and to transfer power to the conductor 44, which in turn conducts power to the shape memory material 42. In one embodiment, the shape memory material 42 is configured to contract in response to receiving electrical power, which causes the latch 40 to move relative to the reel 20. For example, the latch 40 may be configured to be displaced out of the notch 38 in response to actuation of the shape memory material 42. In the illustrated embodiments, the transfer port 45 is located proximate the center of the housing 12, although the transfer port could be located at any desired position that is accessible to an electronic key.

Figure 18:
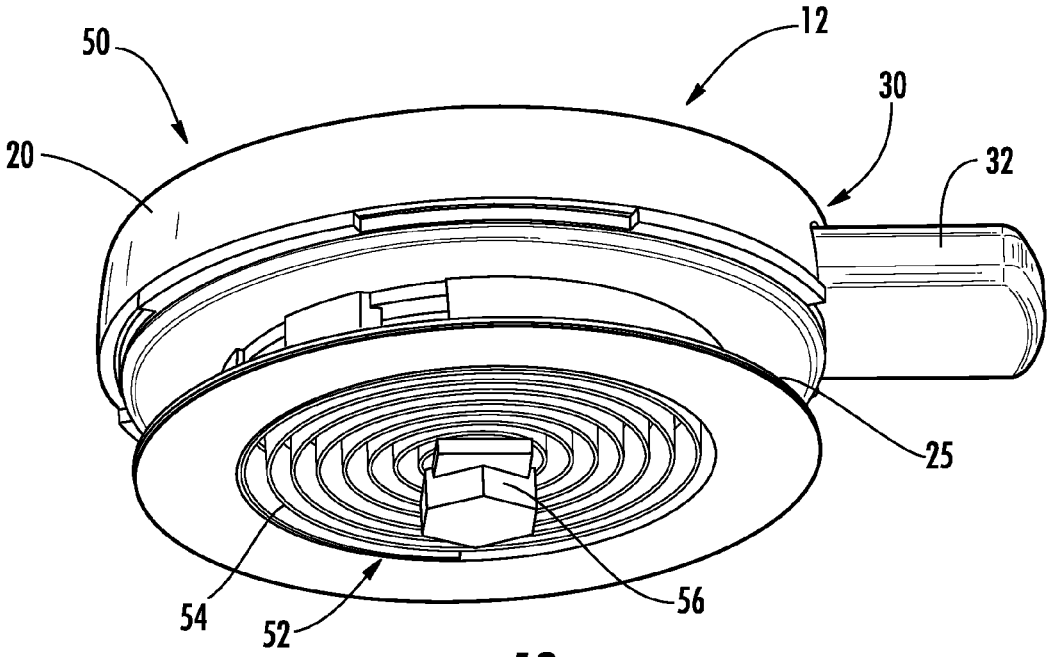
FIG. 18 is another perspective view of the merchandise security device of FIG. 15 with the bottom housing removed for purposes of clarity showing the lock mechanism in the unlocked position.

FIGS. 15-19 illustrate another embodiment of a merchandise security device 50 configured for use with an electronic key according to the invention. The merchandise security device 50 is similar to the merchandise security device 10 previously described above. However, the merchandise security device 50 includes a recoiler 52 (see, FIG. 18) for automatically winding the cable 14 into the housing 12. The cable 14 is operable to unwind as tension is applied to the cable. FIG. 18 shows one embodiment of a recoiler 52 in greater detail. In this regard, the recoiler 52 includes a coiled spring 54 coupled to an arbor 56. The arbor 56 is coupled to the reel 20 and to the bottom housing 22. The spring 54 is configured to wind as the cable 14 is withdrawn from the reel 20, such that the spring 54 is configured to unwind and to bias the reel in an opposite winding direction to retract the cable onto the reel when tension is reduced or is no longer applied to the cable.

Figure 19:
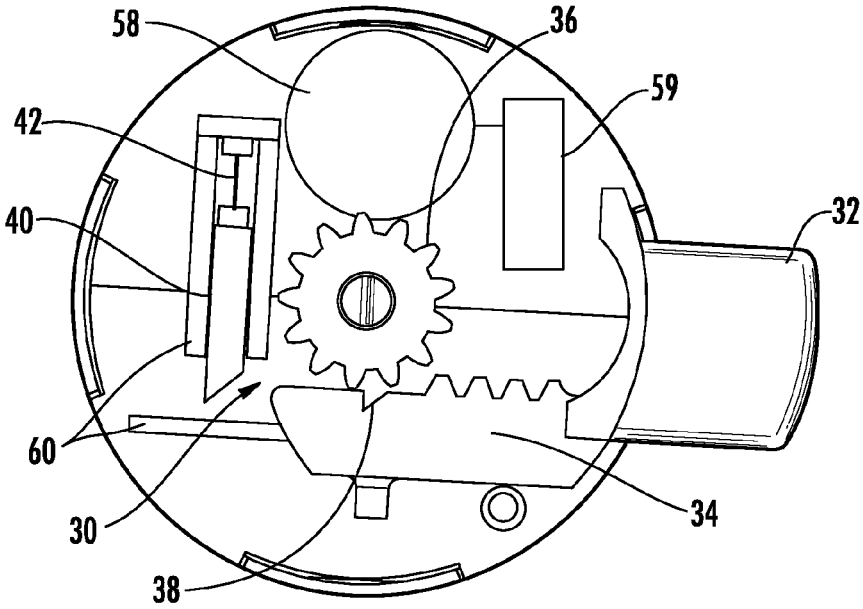
FIG. 19 is a bottom view of the merchandise security device of FIG. 15 with the bottom housing removed for purposes of clarity showing the lock mechanism in the unlocked position.

FIG. 19 shows that the merchandise security device 50 may include the same or similar lock mechanism 30 as previously discussed above. FIG. 19 also shows that the merchandise security device 50 may include a battery 58, such as for powering an alarm circuit 59 as previously discussed above. In addition, FIG. 19 shows that the reel 20 may include various guides 60 for guiding movement of the latch 40 and/or the lock button 32. Moreover, FIG. 19 shows a shape memory wire 42 operably engaged with the latch 40. As shown, contraction of the shape memory wire 42 is configured to retract the latch 40 relative to the lock button 32.

FIGS. 25-30 illustrate another embodiment of a merchandise security device 100 configured for use with an electronic key according to the invention. As previously described, the merchandise security device 100 is configured to cooperate with an electronic key and includes a housing 102 configured to be coupled to a cable 14. The housing 102 in this embodiment may include a reel 104 operably engaged with a bottom housing 106 which functions in a similar manner previously discussed above to wind and unwind the cable 14 from a spool 122 (see, FIG. 28). In this regard, the reel 104 may be configured to rotate relative to the bottom housing 106. Similar to the embodiments previously described above, the bottom housing 106 may define a plurality of openings 105 configured to receive the cable 14 there through.

In addition, the merchandise security device 100 may include a hang tag 108 that is configured to pivot relative to the housing 102 between use and non-use positions, as previously described above. In this embodiment, the hang tag 108 includes an opening 110 that may be configured to receive a user's finger for manually rotating the reel 104 for winding or unwinding the cable 14 when the hang tag is pivoted upwardly to a use position. In addition, the opening 110 may align with a transfer port 145 for communicating with an electronic key, as previously discussed above.

Figure 25:
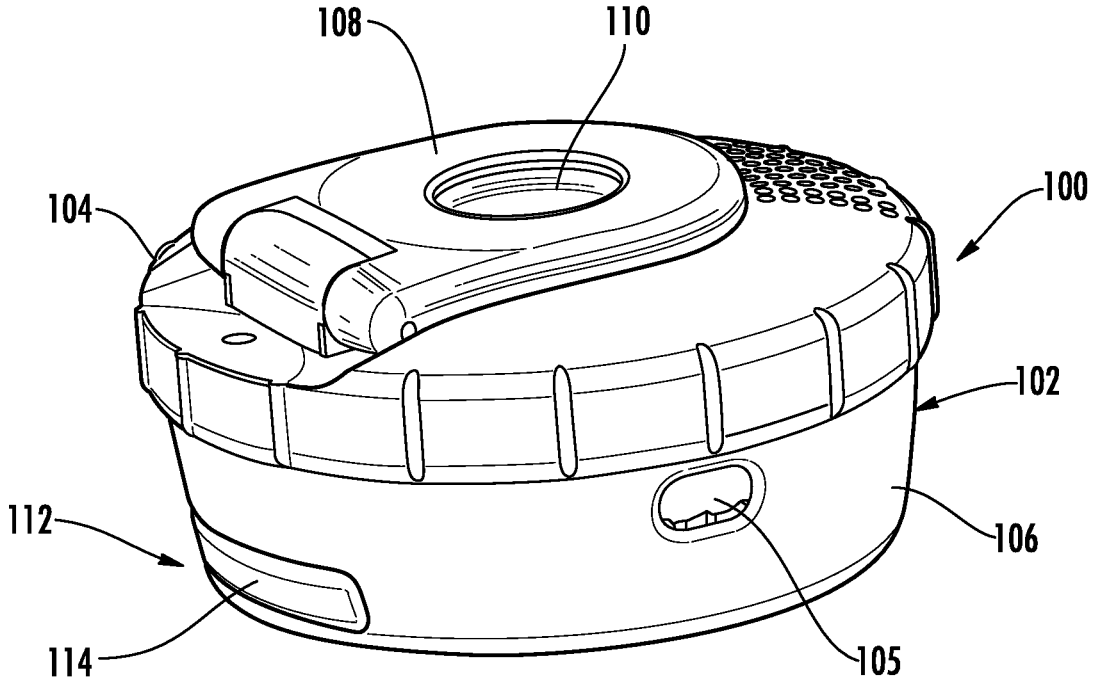
FIG. 25 is a perspective view showing another embodiment of a merchandise security device configured to cooperate with an electronic key for locking and/or unlocking a lock mechanism according to the invention.

FIG. 25 further illustrates that the merchandise security device 100 also includes a lock mechanism 112. The lock mechanism 112 may include a lock button 114 that is configured to be moved between a locked position and an unlocked position. In the illustrated example, the lock button 114 is configured to be moved outwardly to the unlocked position and inwardly within the bottom housing 106 to the locked position. In the locked position, the cable 14 may be locked relative to the housing 102, such that the cable is unable to be withdrawn out of the housing or retracted into the housing.

Figure 26:
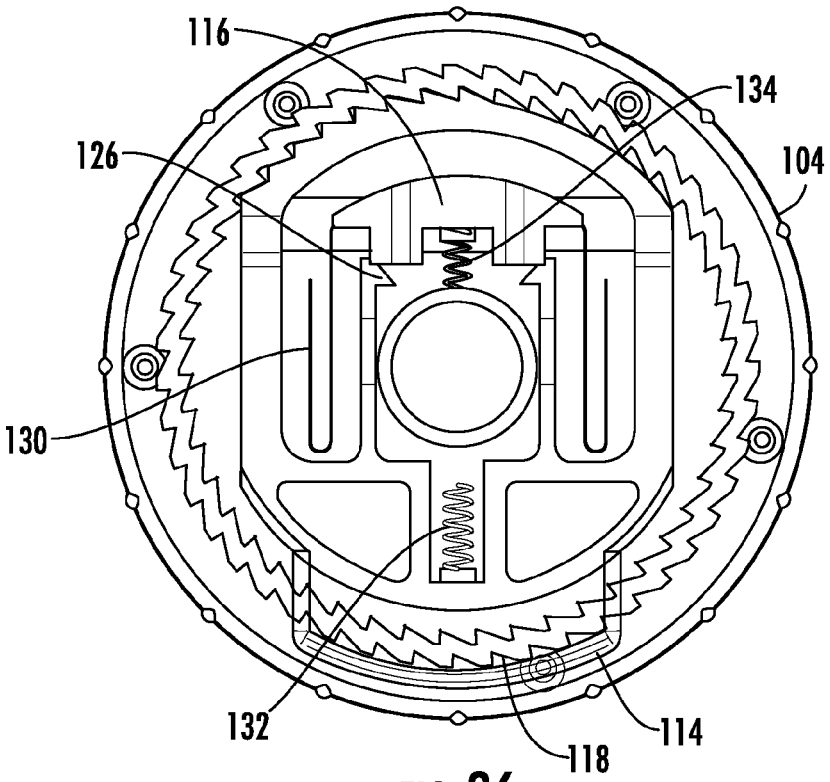
FIG. 26 is a bottom view of the merchandise security device of FIG. 25 with the bottom housing removed for purposes of clarity showing the lock mechanism in a locked position.
Figure 27:
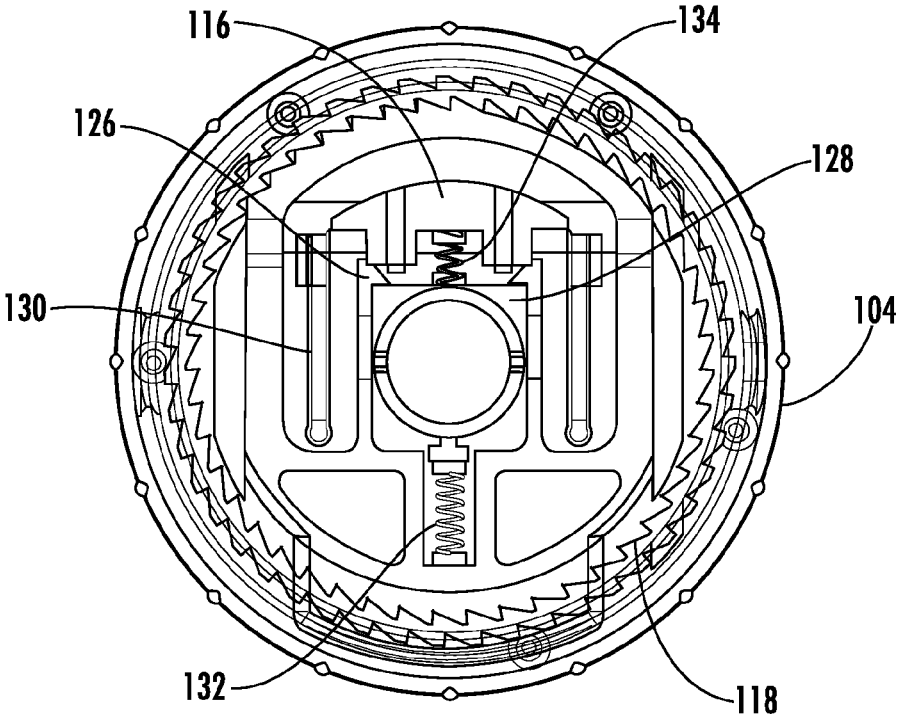
FIG. 27 is another bottom view of the merchandise security device of FIG. 25 with the lock mechanism in the locked position.
Figure 28:
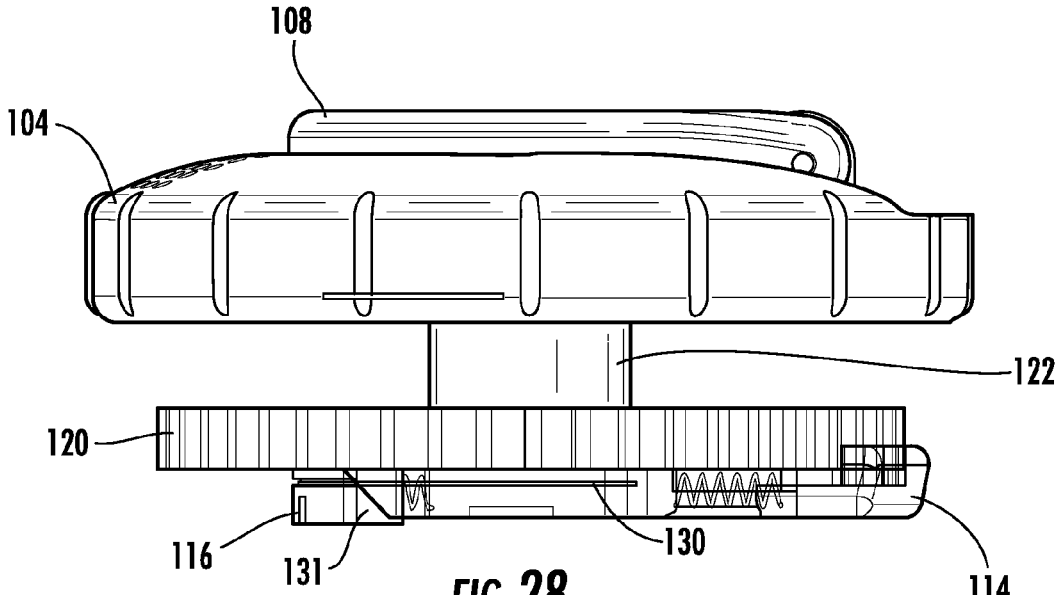
FIG. 28 is a side view of the merchandise security device of FIG. 25 with the bottom housing removed for purposes of clarity showing the lock mechanism in the locked position.
Figure 29:
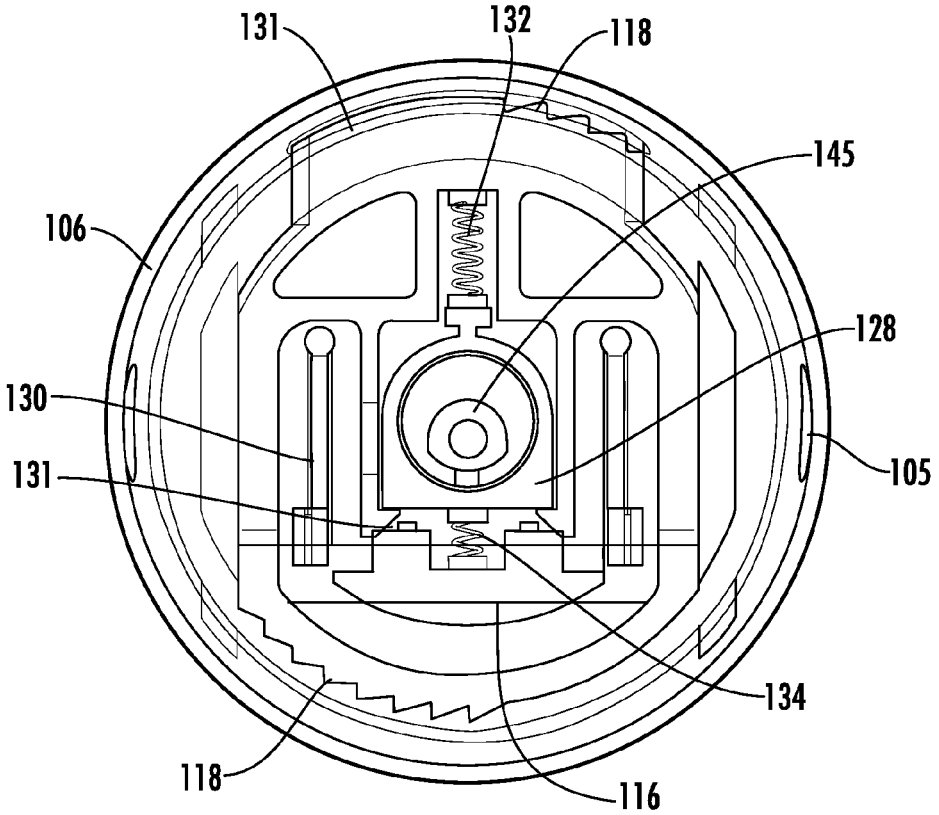
FIG. 29 is a top view of the merchandise security device of FIG. 25 with the reel removed for purposes of clarity showing the lock mechanism in the locked position.
Figure 30:
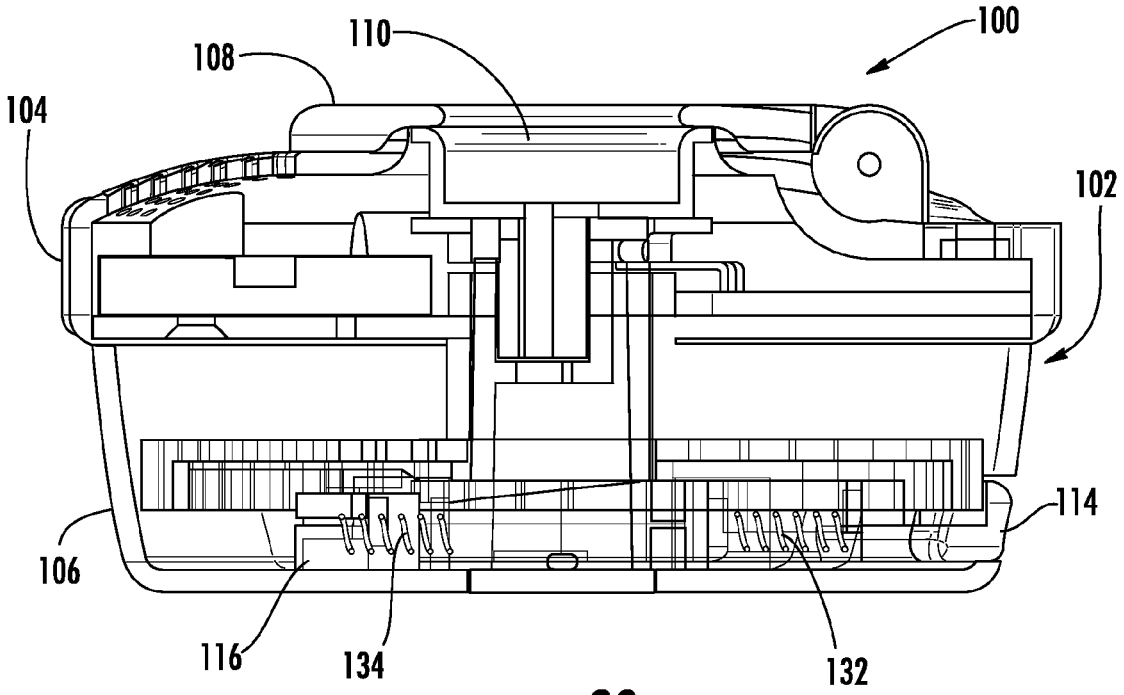
FIG. 30 is a sectional view of the merchandise security device of FIG. 25 showing the lock mechanism in the locked position.

FIGS. 26-29 show the lock mechanism 112 in greater detail. In FIGS. 26 and 28 the bottom housing 106 has been removed for purposes of clarity, while in FIG. 29, the reel 104 has been removed for purposes of clarity. Generally, the lock button 114 is configured to interact with a latch 116 for locking and unlocking the lock mechanism 112. More specifically, the lock button 114 may include a plurality of serrated engagement members 118 that are configured to mate with an engage corresponding serrated engagement members 120 (see, FIG. 28) defined on an interior surface of the spool 122. In this example, the lock button 114 may include engagement members 118 defined at opposite ends thereof, such that the engagement members engage with the engagement members 120 of the spool 122 at more than one location (see, e.g., FIG. 29). However, it is understood that the engagement members 118, 120 may be defined at various locations and any desired configuration of the engagement members may be implemented for achieving mating engagement.

In some embodiments, the latch 116 is configured to move relative to lock button 114 for interacting with a pair of flexible arms 126 associated with the lock button. In this regard, FIG. 27 shows that the flexible arms 126 are configured to engage a portion 128 of the bottom housing in a locked position. Thus, in the locked position, the engagement members 118, 120 are engaged with one another and the spool 122 is unable to rotate to unwind the cable 14 from the spool. In addition, the lock button 114 is configured to be actuated within the bottom housing 106 to the locked position, whereby the flexible arms 126 engage the portion 128 of the bottom housing.

Similar to previously discussed above, the lock mechanism 112 may include a shape memory material 130 for unlocking the lock mechanism. In the embodiment shown in FIGS. 25-30, the shape memory material 130 is operably engaged with the transfer port 145, such as via one or more conductors. The shape memory material 130 may be coupled to the latch 116. Where the shape memory material 130 is configured as a single wire, opposite ends of the shape memory wire may be coupled to the latch 116. When electrical power is transferred to the shape memory material 130, contraction of the shape memory material causes the latch 116 to move towards the flexible arms 126. The ends of the flexible arms 126 may include an angled surface 131 such that the latch 116 is configured to cam or bias the flexible arms outwardly, thereby disengaging the flexible arms from the spool 122. The lock button 114 may be biased with a biasing member 132 (e.g., a spring) for actuating the lock button outwardly of the bottom housing 106 in the unlocked position. Thus, the lock button 114 may be configured to automatically bias outwardly to the unlocked position when the flexible arms 126 disengage the spool 122.

In one embodiment, the latch 116 may also be operably engaged with a biasing member 134 (e.g., a spring). The biasing member 134 may be used to dampen movement of the latch 116 after the shape memory material 130 has contracted and returns to its initial length. Thus, the biasing member 134 may be used to reduce strain applied to the shape memory material 130 between actuated and non-actuated states. It will be apparent that actuation of the shape memory material 130 is sufficient to overcome the force of the biasing element 134 in order to engage the flexible arms 126.

Figure 31:
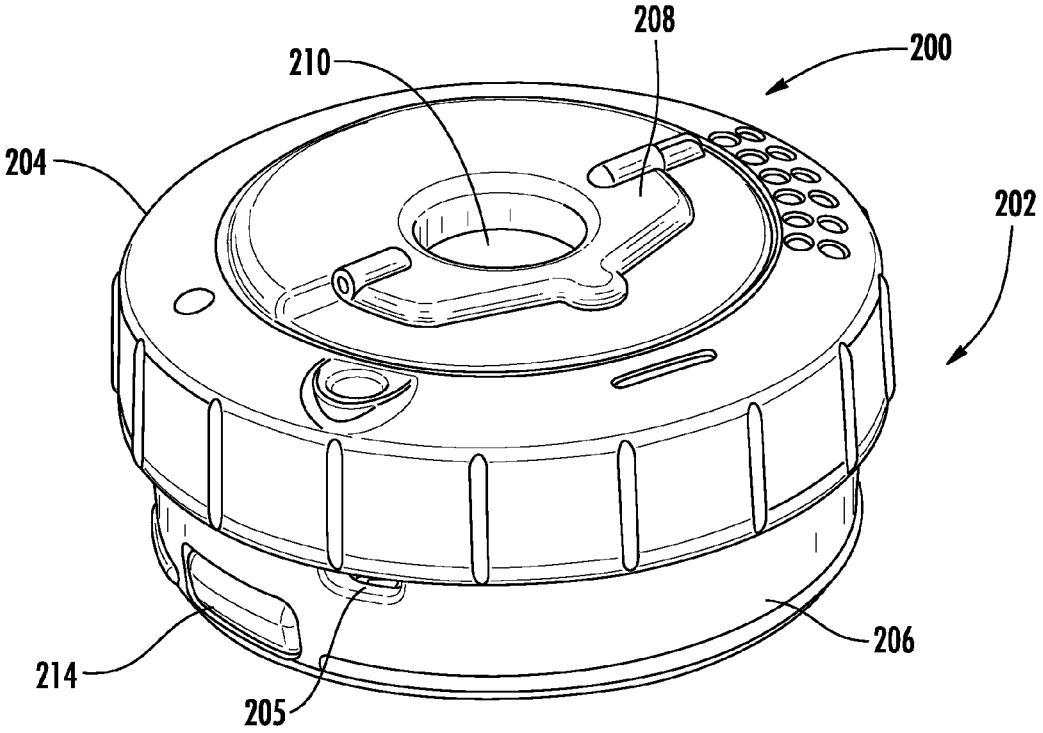
FIG. 31 is a perspective view showing another embodiment of a merchandise security device configured to cooperate with an electronic key for locking and/or unlocking a lock mechanism according to the invention.
Figure 32:
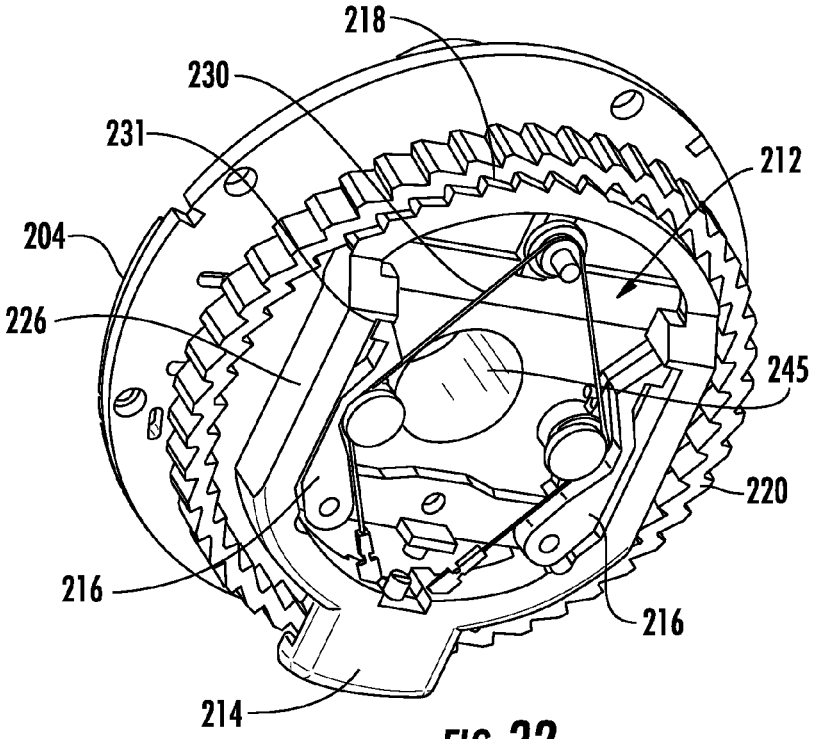
FIG. 32 is a perspective view of the merchandise security device of FIG. 30 with the bottom housing removed for purposes of clarity showing the lock mechanism in a locked position.
Figure 33:
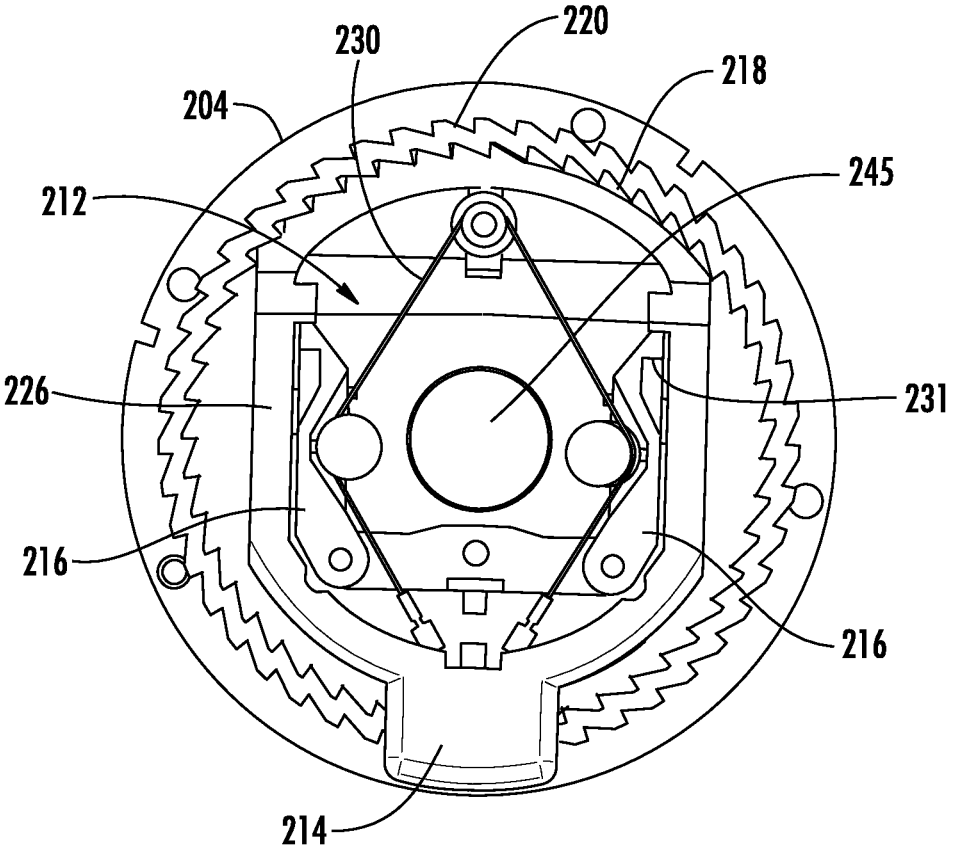
FIG. 33 is a bottom view of the merchandise security device of FIG. 30 with the bottom housing removed for purposes of clarity showing the lock mechanism in the locked position.

FIGS. 31-33 illustrate another embodiment of a merchandise security device 200 configured for use with an electronic key according to the invention. As previously described, the merchandise security device 200 is configured to cooperate with an electronic key and includes a housing 202 configured to be coupled to a cable 14. The housing 202 in this embodiment may include a reel 204 operably engaged with a bottom housing 206 which functions in a similar manner previously discussed above to wind and unwind the cable 14 from a spool. In this regard, the reel 204 may be configured to rotate relative to the bottom housing 206. Similar to the embodiments previously described above, the bottom housing 206 may define a plurality of openings 205 configured to receive the cable 14 there through.

In addition, the merchandise security device 200 may include a hang tag 208 that is configured to pivot relative to the housing 202 between use and non-use positions, as previously described above. In this embodiment, the hang tag 208 includes an opening 210 that may be configured to receive a user's finger for manually rotating the reel 204 for winding or unwinding the cable 14 when the hang tag is pivoted upwardly to a use position. In addition, the opening 210 may align with a transfer port 245 for communicating with an electronic key, as previously discussed above. In some embodiments, the hang tag 208 remains stationary and does not rotate when the reel 204 is rotated. As such, the hang tag 208 may be maintained in a desired orientation while the cable 14 is wound within the housing 202. This may be useful where orientation of the hang tag 208 is desired, such as for receiving a rod or tether therethrough (see, e.g., FIG. 4).

FIGS. 32 and 33 further illustrate that the merchandise security device 200 also includes a lock mechanism 212. The lock mechanism 212 may include a lock button 214 that is configured to be moved between a locked position and an unlocked position. In the illustrated example, the lock button 214 is configured to be moved outwardly to the unlocked position and inwardly within the bottom housing 206 to the locked position. In the locked position, the cable 14 may be locked relative to the housing 202, such that the cable is unable to be withdrawn out of the housing or retracted into the housing.

In FIGS. 32 and 33 the bottom housing 206 has been removed for purposes of clarity. Generally, the lock button 214 is configured to interact with at least one latch 216 for locking and unlocking the lock mechanism 212. More specifically, the lock button 214 may include a plurality of serrated engagement members 218 that are configured to mate with an engage corresponding serrated engagement members 220 defined on an interior surface of the spool. In this example, the lock button 214 may include a plurality of engagement members 218 arranged radially at one end thereof, such that the engagement members engage with the engagement members 220 of the spool at more than one location. However, it is understood that the engagement members 218, 220 may be defined at various locations and any desired configuration of the engagement members may be implemented for achieving mating engagement.

In some embodiments, the at least one latch 216 is configured to move relative to lock button 214 for interacting with at least one arm 226 associated with the lock button. In the embodiment shown in FIGS. 32-33, a pair of latches 216 are configured to pivot relative to a corresponding pair of arms 226 of the lock button 214 into and out of engagement in response to actuation of the lock mechanism 212. In one embodiment, displacement of the lock button 214 into the housing 202 results in engagement of the engagement members 218, 220. The ends of the latches 216 may include a stop surface 231 or other engagement member that are configured to engage the arms 226 of the lock button 214 in a locked position. The spool may be locked in position when the latches 216 are engaged with the arms 226. Thus, in the locked position, the engagement members 218, 220 are engaged with one another and the spool is unable to rotate to unwind the cable 14 from the spool. In addition, the lock button 214 is configured to be actuated within the bottom housing 206 to the locked position, whereby the arms 226 engage the at least one latch 216.

Similar to previously discussed above, the lock mechanism 212 may include a shape memory material 230 for unlocking the lock mechanism. In the embodiment shown in FIGS. 32-33, the shape memory material 230 is operably engaged with the transfer port 245, such as via one or more conductors. The shape memory material 230 may be coupled to the at least one latch 216. Where the shape memory material 230 is configured as a single wire, the shape memory wire may be coupled to a pair of opposed latches 216. When electrical power is transferred to the shape memory material 230, contraction of the shape memory material causes the latches 216 to move away from the arms 226 of the lock button 214. Each latch 216 is configured to pivot or rotate inwardly in response to activation of the shape memory material 230, thereby disengaging the latch from the corresponding arm 226. The lock button 214 may be biased with a biasing member (e.g., a spring) for actuating the lock button outwardly of the bottom housing 206 in the unlocked position. Thus, the lock button 214 may be configured to automatically bias outwardly to the unlocked position when the latches 216 disengage the arms 226 thereby disengaging the spool. In order to relock the lock mechanism 212, the lock button 214 may be displaced within the housing 202, which causes the stop surfaces 231 to engage the arms 226 of the lock button 214. In one example, the stop surfaces 231 and/or the arms 226 may include an angled surface which allows the stop surfaces to slide or otherwise bypass the arms to the locked position.

In some embodiments, the cable is a tether that provides mechanical security only, while in other embodiments, the cable may include one or more conductors electrically connected to an alarm circuit (e.g., 59 shown in FIG. 19). Thus, the alarm circuit may be configured to detect when the cable is severed, cut or removed from the housing in an unauthorized manner. In other embodiments, the cable may include both a cut resistant outer sheath and conductors, although only a cable having a cut-resistant outer sheath may be utilized if desired. Moreover, the housing may include a sensor that is configured to be activated upon unauthorized removal of the housing from an item of merchandise. Furthermore, the sensor may be in electrical communication with the alarm circuit. For example, the sensor may be a pressure, limit or plunger switch. Thus, the alarm circuit may be configured to detect activation of the sensor and to generate an audible and/or a visible alarm signal in response to the sensor being activated. Furthermore, other security features may be employed, such as a tamper sensor that is configured to sense tampering with the cable and/or housing. For example, the housing may include a sensor configured to detect tension being applied to the cable and to generate an alarm signal in response thereto. In addition, the housing could include a sensor (e.g., an encoder) configured to detect unauthorized rotation of the reel, which may also result in generation of an alarm signal. It is understood that the electronic key may be employed to arm and/or disarm an alarm circuit, as well as lock and/or unlock the lock mechanism. In one embodiment, engagement of the lock button into the housing results in arming of the alarm circuit. Thus, in one embodiment, an electronic key is not required to arm the alarm circuit. However, the electronic key may be used to disarm the alarm circuit and/or to unlock the lock mechanism. Moreover, the housing may include an EAS tag or other mechanism configured to provide a signal for generating an alarm signal within the housing or to cause a remote alarm signal to be generated. In some embodiments, the housing may include a motion sensor (e.g., a jiggle switch). For example, the motion sensor may be configured to detect motion of the housing and thereby actuate the power source. The power source may provide power to the alarm circuit, and in some embodiments provide power to an LED. Because the power source is only actuated when motion is detected, the life of the power source may be extended.

According to another exemplary embodiment of the invention, a method for securing a merchandise security device 10 to an item of merchandise M is provided. With reference to FIGS. 1 and 2, a user may first position the housing 12 on a top side S of the item of merchandise M and a medial portion 15 of the cable 14 on a bottom side S of the item of merchandise M. FIGS. 22-24 show that the medial portion 15 may include a distinctive marking to assist the user in positioning the cable 14 on the item of merchandise M. The stabilizing members 16 may be positioned on the front F and rear R sides of the item of merchandise M, while the cable 14 is looped about the lateral sides S of the item of merchandise M. When the cable 14 and stabilizing members 16 are in a desired location, the cable may be tensioned by manually winding the cable on the spool 25 of the housing 12. Once the desired tension is applied, the lock button 32 may be engaged with the housing 12 to lock the lock mechanism 30 and thereby lock the cable 14 relative to the housing 12. Where the merchandise security device 10 includes an alarm circuit, actuating the lock button 32 may also arm the alarm circuit. An electronic key may be used to unlock the lock mechanism 30 through actuation of a shape memory material 42. As such, a mechanical or magnetic key is not required. Although the terms top, bottom, side, front, rear and lateral have been used, it is understood that the terms are not intended to be limiting, as the location of the merchandise security device on the item of merchandise may depend on the orientation of the merchandise security device relative to the item of merchandise.

In light of the aforementioned discussion, it is apparent that any number of lock mechanisms may be employed in conjunction with various forms of power transfer for actuating a lock mechanism (e.g., inductive, capacitive, etc.). For example, where a shape memory material is utilized, a change in shape of the shape memory material may cause mechanical actuation (e.g., linear and/or rotary movement) of the lock mechanism. The shape memory material may be operably engaged with a lock mechanism in any number of configurations to facilitate such actuation. Moreover, the shape memory material may be any suitable material, such as a metal, a polymer, or a combination thereof, that is configured to change in shape (e.g., length, area, etc.) in response to a current or a change in temperature. In addition, other mechanisms may be utilized for actuating a lock mechanism, including mechanical, electrical, and/or chemical state changes. As such, the merchandise security devices and associated lock mechanisms should not be limited in any manner to, or by, the illustrated embodiments.

In some embodiments, the merchandise security device and the electronic key are similar to those disclosed in U.S. Patent Publication No. 2013/0081434, entitled Cabinet Lock for Use with Programmable Electronic Key and filed Sep. 28, 2012, U.S. Patent Publication No. 2012/0047972, entitled Electronic Key for Merchandise Security Device and filed Aug. 31, 2011, U.S. Patent Publication No. 2011/0254661, entitled Programmable Security System and Method for Protecting Merchandise and filed Jun. 27, 2011, and U.S. application Ser. No. 14/328,051, entitled Merchandise Security Devices for Use with an Electronic Key and filed on Jul. 10, 2014, the disclosure of each is incorporated herein by reference in its entirety. In other embodiments, the merchandise security device and the electronic key are similar to those manufactured by InVue Security Products Inc., including the Plunger Locks, Smart Locks, and IR2 and IR2-S Keys.

The foregoing has described one or more embodiments of a merchandise display security system for use with an electronic key. Embodiments of a merchandise security device have been shown and described herein for purposes of illustrating and enabling the best mode of the invention. Those of ordinary skill in the art, however, will readily understand and appreciate that numerous variations and modifications of the invention may be made without departing from the spirit and scope of the invention. Accordingly, all such variations and modifications are intended to be encompassed by the appended claims.

That which is claimed is:

1. A merchandise security device for securing an item of merchandise from theft, the merchandise security device comprising:

a housing operably coupled with a cable and comprising a top surface, a bottom surface, and a side surface extending therebetween, the cable configured to at least partially surround an item of merchandise, wherein the cable is operably engaged with a spool disposed within the housing and is configured to be wound on and unwound from the spool; and a lock mechanism configured to releasably secure the cable relative to the housing for locking the cable about the item of merchandise, wherein the lock mechanism comprises a manually operated lock button disposed on the side surface of the housing and configured to be displaced into the housing for locking the spool relative to the housing such that the cable is unable to unwound from the spool, and wherein the lock mechanism is configured to receive electrical power for unlocking the lock mechanism so that the housing and the cable may be removed from the item of merchandise.

2. The merchandise security device of claim 1, further comprising a shape memory material operably engaged with the lock mechanism and configured to change in shape in response to receiving electrical power for unlocking the lock mechanism so that the housing and the cable may be removed from the item of merchandise.

3. The merchandise security device of claim 1, wherein the lock mechanism is configured to receive electrical power inductively.

4. The merchandise security device of claim 1, wherein the housing comprises an alarm circuit, and wherein the cable comprises at least one conductor in electrical communication with the alarm circuit.

5. The merchandise security device of claim 1, wherein the cable is configured to be manually wound into the housing.

6. The merchandise security device of claim 1, wherein the lock button and the spool each comprises a plurality of engagement members, and wherein the plurality of engagement members are configured to engage with one another when the lock button is displaced into the housing.

7. The merchandise security device of claim 1, further comprising a latch configured to releasably engage the lock button when the lock button is displaced within the housing.

8. The merchandise security device of claim 7, further comprising a shape memory material operably engaged with the latch and configured to change in shape in response to receiving electrical power for disengaging the latch from the lock button.

9. The merchandise security device of claim 1, wherein the cable is a single continuous loop.

10. The merchandise security device of claim 9, further comprising a plurality of stabilizing members disposed on the cable, wherein the item of merchandise comprises a front surface and a rear surface and a lateral side extending therebetween, and wherein the housing is configured to be positioned on the lateral side and the stabilizing members are configured to be positioned on the front surface of the item of merchandise and on the rear surface of the item of merchandise.

11. The merchandise security device of claim 9, wherein the housing defines a pair of openings, each opening disposed radially opposite the another, each of the openings configured to receive the cable therethrough.

12. The merchandise security device of claim 1, wherein the cable is configured to be wound and unwound from the housing for extending and retracting the cable relative to the housing, and wherein the lock mechanism does not include a ratchet mechanism for winding the cable within the housing.

13. The merchandise security device of claim 1, further comprising a hang tag coupled to the housing, wherein a portion of the housing is configured to be rotated for winding or unwinding the cable while the hang tag remains stationary.

14. The merchandise security device of claim 1, wherein the cable is configured to be extended and retracted relative to the housing.

15. The merchandise security device of claim 1, further comprising a transfer port on the top surface of the housing for communicating with an electronic key for receiving electrical power.

16. The merchandise security device of claim 1, wherein the lock mechanism is configured to receive electrical power from an electronic key for unlocking the lock mechanism.

17. A method for securing an item of merchandise from theft, the method comprising:

positioning a housing adjacent to an item of merchandise, the housing operably coupled with a cable and comprising a top surface, a bottom surface, and a side surface extending therebetween, wherein the cable is operably engaged with a spool disposed within the housing and is configured to be wound on and unwound from the spool;

at least partially surrounding the item of merchandise with the cable;

rotating the spool to tighten the cable about the item of merchandise;

engaging a lock mechanism for releasably securing the cable relative to the housing such that the cable is locked about the item of merchandise and the spool is unable to rotate to unwind the cable from the spool, wherein engaging comprises inserting a manually operated lock button within the side surface of the housing; and actuating the lock mechanism with electrical power to unlock the lock mechanism to facilitate removal of the housing and the cable from the item of merchandise.

18. The method of claim 17, wherein the item of merchandise comprises a front surface and a rear surface and a lateral side extending therebetween, and wherein positioning comprises positioning the housing on the lateral side of the item of merchandise.

19. The method of claim 18, wherein positioning comprises positioning a first stabilizing member on the front surface of the item of merchandise and positioning a second stabilizing member on the rear surface of the item of merchandise.

20. The method of claim 17, wherein actuating comprises actuating the lock mechanism with electrical power to unlock the lock mechanism in response to a change in shape of a shape memory material operably engaged with the lock mechanism to facilitate removal of the housing and the cable from the item of merchandise.

21. The method of claim 17, further comprising manually winding the cable within the housing for tightening the cable about the item of merchandise.

22. The method of claim 17, wherein winding does not comprise winding using a ratchet mechanism.

* * * * *